US005281476A

United States Patent [19]

Koyonagi et al.

[11] Patent Number: 5,281,476

[45] Date of Patent: Jan. 25, 1994

[54] CRIMPED MULTIFILAMENT AND METHOD FOR MANUFACTURING THE SAME

[75] Inventors: Tadashi Koyonagi; Hironori Hamada; Yumio Endoh; Teruhiko Matsuo, all of Nobeoka, Japan

[73] Assignee: Asahi Kasei Kogyo Kabushiki Kaisha, Osaka, Japan

[21] Appl. No.: 990,051

[22] Filed: Dec. 11, 1992

Related U.S. Application Data

[63] Continuation of Ser. No. 730,945, Jul. 29, 1991, abandoned.

[30] Foreign Application Priority Data

| | | | |
|---|---|---|---|
| May 30, 1988 | [JP] | Japan | 63-130415 |
| Jun. 9, 1988 | [JP] | Japan | 63-140505 |
| Apr. 6, 1989 | [JP] | Japan | 1-85711 |
| Nov. 30, 1989 | [JP] | Japan | 1-309009 |

[51] Int. Cl.[5] ..... D02G 3/00

[52] U.S. Cl. ..... 428/357; 428/362; 428/369; 428/371

[58] Field of Search ..... 264/168, 357; 428/364, 428/369, 371, 373, 362

[56] References Cited

U.S. PATENT DOCUMENTS

| | | | |
|---|---|---|---|
| 3,608,044 | 9/1971 | Coplan | 264/210.7 |
| 3,920,784 | 11/1975 | Nakagawa et al. | 428/369 |
| 4,134,882 | 1/1979 | Frankfort et al. | 528/308.2 |
| 4,195,051 | 3/1980 | Frankfort et al. | 264/210.2 |
| 4,415,726 | 11/1983 | Tanji et al. | 528/272 |
| 4,496,505 | 1/1985 | Tanji et al. | 264/101 |
| 4,542,063 | 9/1985 | Tanji et al. | 264/78 |

FOREIGN PATENT DOCUMENTS 55-10751 8/1980 Japan .

*Primary Examiner*—Patrick J. Ryan
*Assistant Examiner*—N. Edwards
*Attorney, Agent, or Firm*—Finnegan, Henderson, Farabow, Garrett, Dunner

[57] ABSTRACT

A crimped multifilament composed of a thermoplastic polymer, wherein a birefringence index measured at an outer layer of a filament constituting said multifilament is larger than that of a birefringence index measured at a central portion of the filament, and said filament has a distribution in which a position having a smallest value of the birefringence index deviates from the center axis of the filament and random crimps of 10 per inch or more.

A crystal growth rate measured by a wide-angle X-ray diffractometry is 0.2 or more for a polyamide crimped multifilament and 0.4 or more for a polyester crimped multifilament.

A preferable method for manufacturing the crimped multifilament is that a multifilament extruded from. a spinneret (2) is applied with an aqueous liquid (5) to one side thereof up to state that a temperature of the multifilament becomes to a predetermined temperature, the obtained multifilament is drawn at the drawing ratio between 1.0 and 1.5 and then is applied with a liquid injecting treatment (for a nylon crimped multifilament) or a heat treatment under relaxation at the temperature of 150° C. or more.

1 Claim, 11 Drawing Sheets

CRIMPED MULTIFILAMENT AND METHOD FOR MANUFACTURING THE SAME

This application is a continuation of application Ser. No. 07/730,945 filed Jul. 29, 1991 is now abandoned.

TECHNICAL FIELD

This invention relates to a crimped multifilament having a crimp a shape of which is random (hereafter referred to a random crimp) and a method for manufacturing the same.

The crimped multifilament in accordance with the present invention may be included a tow to be used for manufacturing a staple fiber.

More particularly, this invention relates to a random crimped multifilament not obtained by a mechanical treatment such as a falsetwist treatment, but can be obtained by a method based on a high speed spinning method, and which can usefully use as a multifilament or a staple fiber, and a method for manufacturing the same at a lower cost.

PRIOR ART

A crimped filament obtained by applying a fiber of a thermoplastic polymer with a mechanical treatment such as a falsetwist treatment, a stuffing box type crimping treatment or the like has been broadly used in a form of a multifilament or a spun yarn for a carpet.

However, a production speed of the crimped multifilament in the mechanical treatment is between several hundreds m/min and 3,000 m/min at most, accordingly the manufacture of the crimped multifilament performed by the mechanical treatment has a high production cost and requires excessive energy and a manual operation and results in an extremely high cost of the obtained crimped multifilament.

U.S. Pat. Nos. 4,542,063 corresponding Japanese Examined Patent Publication No. 64-6282 and No. 4,415,726 corresponding to Japanese Examined Patent Publication No. 64-8086 disclosed a matter that when a polyamide polymer or a polyester polymer is spun by a high speed spinning method, a molecular orientation and a crystallization increase with an increase of a spinning speed, and a multifilament just after spinning has sufficient mechanical properties which is substantially equal to those of an conventional multifilament manufactured by a low speed spinning and drawing method, and a woven fabric and a knitted fabric can be manufactured from this multifilament without applying a drawing treatment. It is expected to obtain a crimped multifilament of a lower price by applying the multifilament manufactured by the high speed spinning method with a crimping treatment, but since a growth of the crystal becomes excessive, it becomes to clear that a random crimp cannot be obtained in the crimping treatment.

Further, it becomes clear that when a multifilament having a denier of a monofilament between 10 d and 10 d required as a multifilament used in a carpet is manufactured from a material having an extremely high crystallinity speed, such as a polyamide, a spherulite generates in a spun monofilament, a clarity is remarkably reduced, a smoothness is lost and result is a degradation of the value of the merchandise. The generation of the spherulite could not solved by combining a method disclosed in Japanese Unexamined Patent Publication (Kokai) No. 58-36213 and using a method in which the multifilament is spun under a non-water system with a method disclosed in Japanese Unexamined Patent Publication (Kokai) No. 63-99324 and including an inorganic metal salz.

As one method for obtaining the crimped multifilament by using the high speed spinning method, Japanese Unexamined Patent Publication (Kokai) No. 55-107511 and The Society of Fiber Science and Technology, Vol. 37, No. 4 (1981) T135–T142 disclosed a method of obtaining a crimped multifilament by applying a biased cooling to a polyester multifilament with an air having a low temperature in a high speed spinning process of 8000 m/min or more.

A filament constituting the polyester multifilament disclosed in the above publication has a structure having a difference of birefringence between an outside layer and an inside layer in a cross section, and an eccentric distribution of the birefringence biased from a fiber axis of the filament, and then a weak spiral crimp appears in the filament just after spinning. However, the filament obtained in accordance with this publication has also an excess growth of crystal, as apparently shown in a crystal structure obtained by a wide-angle X-ray diffractometry. Accordingly even if a heat treatment is further applied to the filament, it is impossible to obtain a random crimp and the spiral crimp is retained, and thus a useful crimped multifilament could not be obtained. Further when a method disclosed in U.S. Pat. Nos. 4,238,439 and 4,619,803 is used for spinning a polyamide at a high speed, the obtained result is the same as that of the above case.

U.S Pat. Nos. 4,038,357 and 4,301,102 and Japanese Unexamined Patent Publication (Kokai) No. 62-23816 disclosed a method of "Spin Texturing" in which a crimped multifilament is obtained by applying an aqueous liquid to multifilament before setting to a solid. A distribution of birefringence index having substantially eccentric state is generated in those methods of applying a crimp, and a crimped multifilament having a spiral shape can be obtained.

The two former cases i.e., U.S. Pat. Nos. 4,038,357 and 4,301,102 relate to a polyamide multifilament and only disclosed one using a spinning and taking speed of 2,300 m/min at most. A distribution of the birefringence having an eccentric state in this case is caused by asymmetrical cooling using a crossing air current and is substantially the same as that in the above-mentioned U.S. Pat. No. 4,238,439. Namely the application of the aqueous liquid in this case intend only to sufficiently impregnate the filament in the aqueous liquid, and then the crimped multifilament obtained by the methods disclosed in those publications have a spiral crimp having a tendency of turning in a reverse direction, even if a liquid injecting treatment is applied Accordingly, the obtained multifilament has a weak crimp elasticity and when the multifilament is used in a carpet or the like, it is impossible to obtain sufficient bulkiness.

The, Japanese Unexamined Patent Publication (Kokai) 62-238816 relates to a polyester multifilament and discloses a method of cooling a multifilament extruded at a spinning speed of 6,000 m/min or more at a vicinity of a point where slenderization of the extruded filament is completed by on a liquid. Also in the above method, a spiral crimp is generated due to a remarkably grown crystal caused by the high-speed spinning. Accordingly it is impossible to apply a random crimp to the filament even if a subsequent heat treatment is applied.

As described above, known methods for manufacturing a crimped multifilament which are based on a high-speed spinning at a spinning speed of around 4000 m/min or more, provide a spiral crimped filament having a lower bulkiness and resiliency, but fails to provide a crimped filament having a random shape sufficient for practical use due to the excess growth of the crystal, even if the subsequent heat treatment such as fluid injecting treatment is applied. Namely, in case that the multifilament having a spiral crimp is used for a carpet yarn, it is easily allowed to extend the spiral crimp during a tufting process and hence a covering property of the carpet falls short.

Further when staple fibers are manufactured by cutting the crimped multifilament, i.e., a tow in this case and a spun yarn is manufactured, there arise plenty of carding waste during a card processing, and hence a workability is remarkably impaired.

Accordingly, it has been strongly desired to provide a random crimped multifilament having superior fastness to crimp and a method for manufacturing the random crimped multifilament at a high speed and a lower cost.

DISCLOSURE OF THE INVENTION

A primary object of the present invention is to provide a crimped multifilament of a thermoplastic synthetic fiber having a random crimp a fastness of which is superior.

A second object of the present invention is to provide a polyamide crimped multifilament having a random crimp a fastness of which is superior and a smooth surface.

A third object of the present invention is to provide a polyester crimped multifilament having a random crimp a fastness of which is superior.

A fourth object of the present invention is to provide a polyester staple fiber having a random crimp a fastness of which is superior.

A fifth object of the present invention is to provide a method for manufacturing a polyamide crimped multifilament having a random crimp a fastness of which is superior and a smooth surface.

A sixth object of the present invention is to provide a method for manufacturing a polyester crimped multifilament having a random crimp a fastness of which is superior.

In order to overcome the above problems, the present inventors have investigated energetically to find that although a crystal growth is suppressed in the filament spun at a high-speed under a specified cooling condition, a subsequent heat-treatment allows a crystal structure to grow up to a size equal to that of a filament spun at a higher speed of 4000 m/min or more in general.

Under this technical result, it became first possible to apply the random crimp to a filament spun at the higher speed of 4000 m/min or more. Further the obtained random crimped filament has a smooth surface, and a superior fastness to crimp due to, a highly grown crystal structure which is a specific feature of the filament spun at the higher speed and a specific distribution of a birefringence index, thus the present invention is completed.

The primary object of the present invention can be attained by a crimped multifilament composed of a thermoplastic polymer, wherein a birefringence index measured at an outer layer of a filament constituting the multifilament is larger than that of a birefringence index measured at a central portion of the filament, and said filament has a distribution in which a position having a smallest value of the birefringence index deviates from the center axis of the filament and random crimps of 10 per inch or more.

The second object of the present invention can be attained by a polyamide crimped multifilament composed of a polyamide polymer, wherein a birefringence index measured at an outer layer of a filament constituting said multifilament is larger than that of a birefringence index measured at a central portion of the filament, and said filament has a distribution in which a position having a smallest value of the birefringence index deviates from a central axis of the filament, a crystal growth rate of 0.2 or more which is measured by a wide-angle X-ray diffractometry, and random crimps of 10 per inch or more.

The third object of the present invention can be attained by a polyester crimped multifilament composed of a polyester polymer, wherein a birefringence index measured at an outer layer of a filament constituting said multifilament is larger than that of a birefringence index measured at a central portion of the filament, and said filament has a distribution in which a position having the smallest value of the birefringence index deviates from a central axis of the filament, a crystal growth rate of 0.4 or more which is measured by a wide-angle X-ray diffractometry, and random crimps of 10 per inch or more.

The fourth object of the present invention can be attained by a polyester staple fiber composed of a polyester polymer, wherein a birefringence index measured at an outer layers of a filament constituting said multifilament is larger than that of a birefringence index measured at a central portion of the filament, and said filament has a distribution in which a position having a smallest value of the birefringence index deviates from a central axis of the filament, a crystal growth rate of 0.4 or more which is measured by a wide-angle X-ray diffractometry, and random crimps of 10 per inch or more.

The fifth object of the present invention can be attained a method for manufacturing a polyamide crimped multifilament by melt spinning a polyamide, characterized is that a multifilament extruded from a spinneret is asymmetrically cooled by applying an aqueous liquid to one side of the multifilament up to a state that a temperature of a filament constituting said multifilament becomes 100° C., and then is taken out at the spinning rate of 4000 m/min or more, and a taken multifilament is drawn at the drawing ratio between 1.0 and 1.5 and then is applied with a fluid injecting treatment at a temperature of 150° C. or more.

The sixth object of the present invention can be attained by a method for manufacturing a polyester crimped multifilament by melt spinning a polyester, characterized in that a multifilament extruded from a spinneret is asymmetrically cooled by applying an aqueous liquid to one side of the multifilament up to a state that a temperature of a filament constituting said multifilament becomes 150° C., and then is taken out at the spinning rate of 5000 m/min or more, and the taken multifilament is drawn at the drawing ratio between 1.0 and 1.5 and then is applied with a heat treatment under relaxation at a temperature of 150° C. or more.

BEST MODE FOR CARRYING OUT THE INVENTION

An essential feature of a crimped multifilament in accordance with the present invention is that a filament constituting the multifilament has a random shaped crimp.

The random crimp in the present invention means a three-dimensional crimp having no torque and in which each crimp is irregularly generated, and thus the random crimp is clearly distinguished from torque type crimp obtained by a false-twist treatment and a spiral crimp obtained by a composite spinning or a mechanically rubbing method.

Figure 1A:
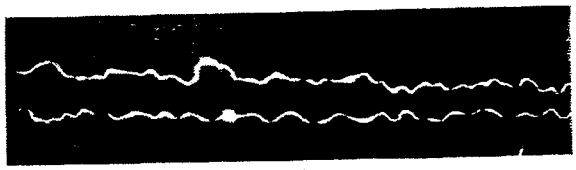
FIG. 1(A) is a photograph showing a random crimp of a crimped multifilament in accordance with the present invention.
Figure 1B:
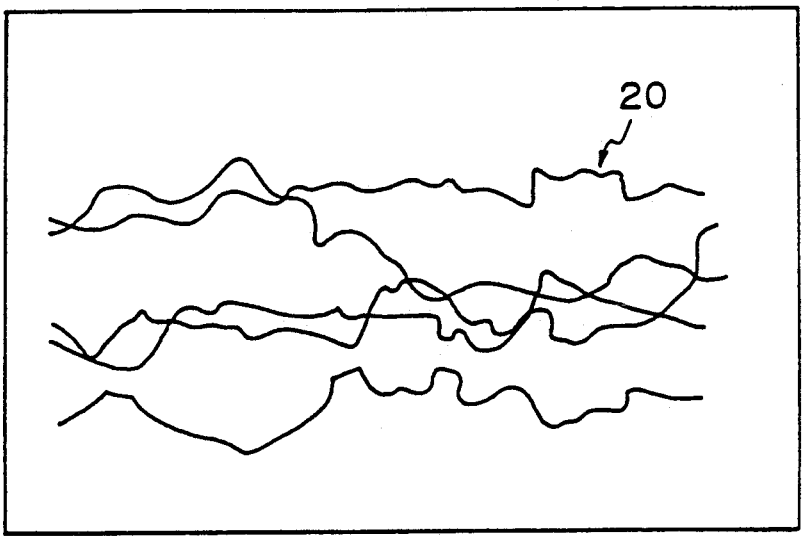
FIG. 1(B) is a view schematically illustrating a random crimp.
Figure 2:
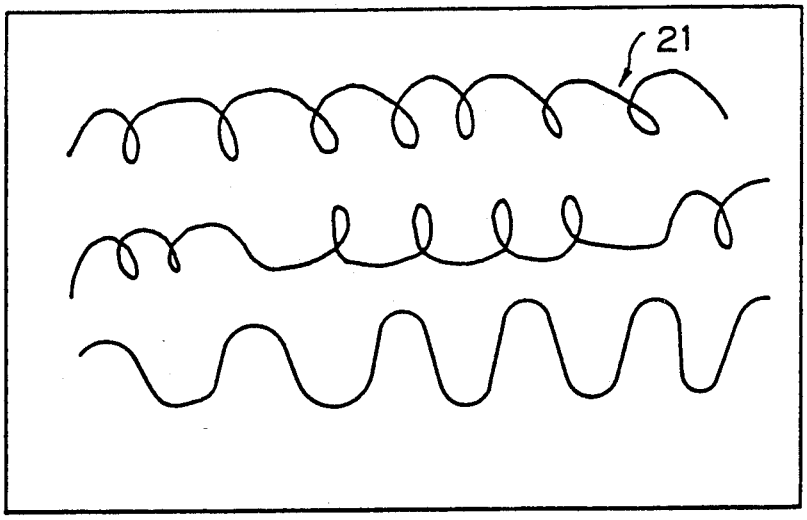
FIG. 2 is a view schematically illustrating a spiral crimp.

FIG. 1(A) shows a photograph of the random crimp in accordance with the present invention and FIG. 1(B) is a view of schematically showing the photograph of FIG. 1(A). FIG. 2 is a view illustrating schematically a spiral crimp to compare the random crimp shown in FIG. 1(B).

The random shape of the crimp is a factor applying sufficient resilience for a stretching operation and a compressing operation to the filament. It is unsuitable to use the spiral crimp for a carpet or the like due to an inferior compression properties and a lack of rigidity.

It is required that a number of crimp of 10 per inch or more are applied to the filament of the multifilament in accordance with the present invention. When the number of crimp is under 10 per inch, it is impossible to satisfy the compression properties in the carpet or the like. Further when a staple fiber is made by cutting the crimped multifilament, a lot of carding waste is generated in a carding process and thus a processability becomes inferior.

It is required in a crimp filament used for a carpet that an extensibility of the crimp should be 10% or more as well as the appropriate number of crimps. The crimped filament in accordance with the present invention, however, has a extensibility of 10% or more providing the number of crimps is 10 per inch or more, which satisfies the foregoing requirements. Preferably, more, and an extensibility of about 20% to 50%.

The crimped multifilament in accordance with the present invention has a specific distribution of a birefringence index that a birefringence index measured at an outer layer of the filament constituting the multifilament is larger than that of a birefringence index measured at a central portion of the filament, and a position having a smallest value of the birefringence index deviates from the center axis of the filament.

Figures 3A, 3B, 3C:
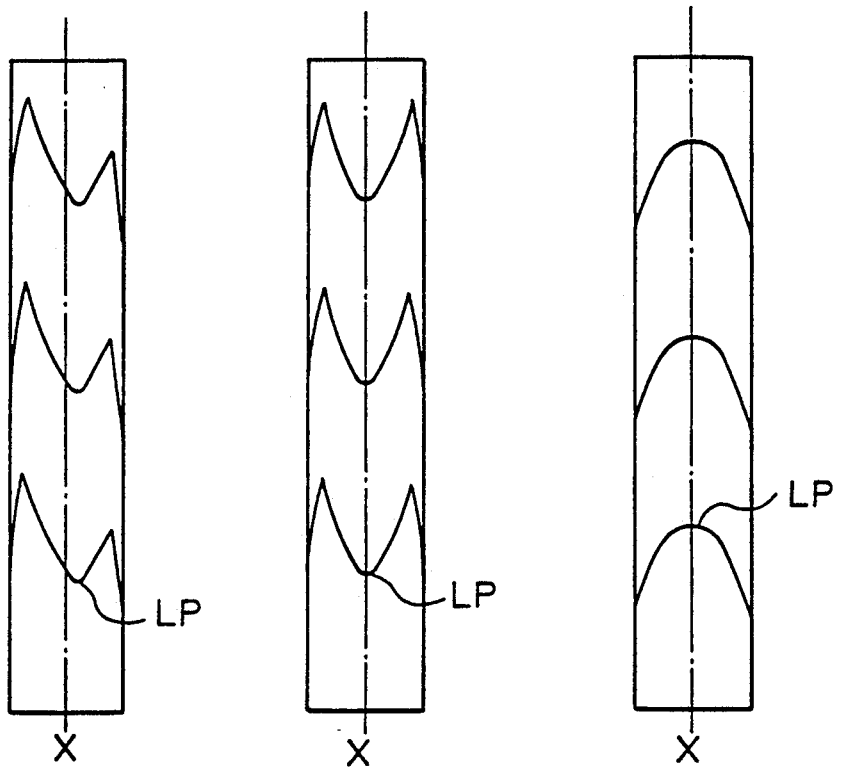
FIGS. 3(A) to 3(C) are patterns of transmission quantitative interference microphotographs depicting various distributions of birefringence index of a filament in accordance with the present invention.

When a cross section of the filament is circular, the distribution and the eccentricity of the birefringence index can be observed according to a method using a transmission interference microscope and which is described in detail latter. The distribution of birefringence index can be measured from U-letter type or V-letter type interference bands as shown in FIG. 3(A) and FIG. 3(B). When the distribution of birefringence index deviates from a center of the filament, a lower point LP of an interference band removes from a central axis X—X of the filament.

When the cross section of the filament is an odd shape, it is impossible to observe the birefringence index by the transmission interference microscope used for the filament having the circular cross section. Accordingly, in this case, presence of the eccentricity can be measured by taking a photograph of a cross section of a dyed filament by a optical microscope and measuring a length that the dyestuff permeates from a surface of the filament as shown in Journal of the Textile Machinery Society of Japan Vol. 33, No. 11 (1980) p. 551 to 554.

Further, in practice, it is possible to estimate a distribution of birefringence index of a filament having an odd cross section by spinning a filament having a circular cross section under the same conditions as those used for spinning the filament having the odd cross section and observing a microphotograph of the filament having the circular cross section.

Figure 4:
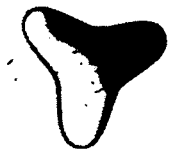
FIG. 4(A) is a microphotograph of a cross section of a dyed filament in accordance with the present invention.
FIG. 4(B) is a microphotograph of a cross section of a dyed filament constituting a conventional crimped multifilament.
Figure 4:
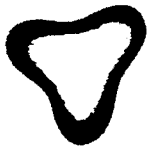

FIG. 4(A) is a photo of the cross section of the dyed filament in accordance with the present invention. As shown in FIG. 4(A), a permeating area of the dyestuff is greatly deviated from a geometrical center in the cross section. FIG. 4(B) shows a microphotograph of a cross section of a dyed filament of a conventional crimped multifilament.

The definition of an eccentricity in a case that the cross section of the filament is asymmetrical and has a complicated profile is defined on the basis of a geometrical center of gravity.

The fastness to crimp of the multifilament in accordance with the present invention becomes superior due to the above-mentioned specific distribution of birefringence index.

A thermoplastic polymer in the present invention ans a polyamide such as a nylon 66, a nylon 6, a nylon 12, a nylon 46 or the like, a polyester such as a polyethylene terephthalate, a polybutylene terephthalate, a polyethylene isophthalate or the like as well as a fiber formable polymer such as a polypropylene, a polyethylene or the like. If necessary, an additive such as an antistat, a delustering agent, a flame retarder or the like may be included.

For general, the present invention presents superior effects in particular when applied to a polyamide or a polyester.

In a case of polyamide which is represented by the nylon 66 and the nylon 6 and having a circular cross section, the birefringence indexes of the filament have preferably a difference of $5\times10^{-3}$ to $45\times10^{-3}$ between the outer layer and an internal layer and a distribution deviated from a center of the filament. When the difference $\delta(\Delta n)$ of the birefringence indexes in the cross section is less than $5\times10^{-3}$, the number of crimps become insufficient and thus the object of the present invention cannot be attained.

In a case of polyamide, a crystal growth rate of the filament obtained by a wide-angle X-ray diffractometry is preferably 0.2 or more. In a case that the polyamide is a polyhexamethylene adipamide, it is desirable that a crystal perfection index is 70% or more.

The crystal growth rate and the crystal perfection index can be measured by a latterly described method using a wide-angle X-ray diffractometry. The crystal growth rate is an indication expressing a degree of crystal growth. The nearer to 1 the value of the crystal growth rate comes, the bigger the crystal growth is. It is apparent that the crystal in the crimped multifilament in accordance with the present invention is extremely grown, by the fact that a value of the crystal growth rate of a conventional filament manufactured by a lower speed spinning and drawing process is 0.15 or less. A preferable crystal growth rate is 0.25 or more.

The crystal perfection index means an indication expressing mainly a size of crystal and the nearer to 100% the value of the crystal perfection index, the heighest perfection of the crystal is. It is apparent that the crimped multifilament is accordance with the present invention has an extremely higher crystal perfection index by the fact that a polyamide filament manufactured by a lower speed spinning and drawing process has the crystal perfection index of 40% to 60%.

The polyamide crimped multifilament in accordance with the present invention have not completely a spherulite and thus a smoothness on a surface of the filament is superior. In the conventional polyamide filament manufactured by the high-speed spinning process, a lot of spherulites are generated or the surface of filaments due to high crystallization speed, and thus the smoothness of the surface of filament is impaired, and the filament is devitrificated. Accordingly, it is impossible to have a clearer color development and a superior luster from the dyed filament.

The above described spherulite cannot be observed from the crimped multifilament in accordance with the present invention and thus this multifilament has a superior transparency. This feature is more enhanced for a filament having a denier of 10 d or more.

The smoothness of a filament surface can be easily observed by a conventional electromicroscope having a magnification of around 500 to around 2000.

Figure 5A:
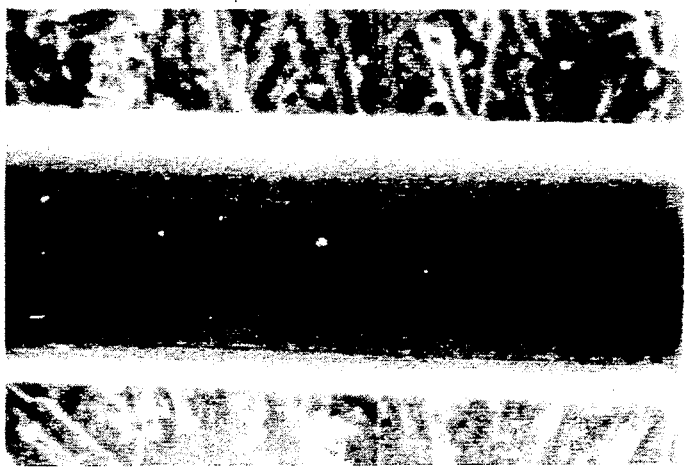
FIG. 5(A) is an electron micrograph showing a smoothness of a surface of the crimped filament in accordance with the present invention.
Figure 5B:
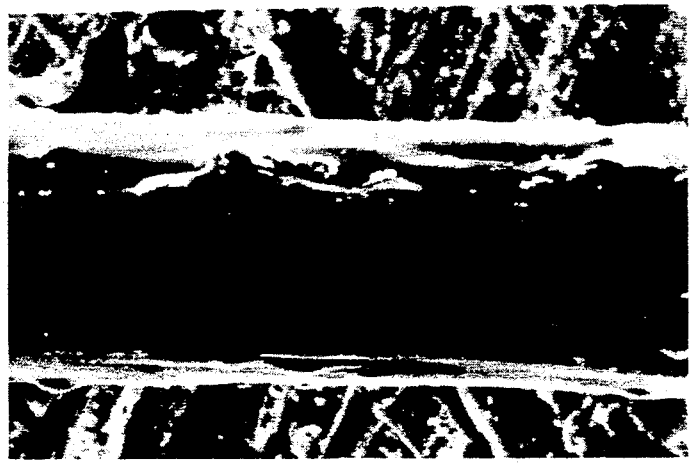
FIG. 5(B) is an electron micrograph showing a smoothness of a surface of the conventional crimped filament.

FIG. 5 shows an electro micrograph of a nylon 66 crimped filament, with no spherulites in the crimped filament in accordance with the present invention as shown in FIG. 5(A), and generation of the spherulites is confirmed in a conventional crimped filament as shown in FIG. 5(B).

A case using a polyester represented by a polyethylene terephthalate and a polybutylene terephthalate as the thermoplastic polymer will be explained hereafter.

When the cross section of the filament is circular, the birefringence indexes of the filament have preferably a difference of $20\times10^{-3}$ to $100\times10^{-3}$ between the outer layer and the inner layer and a distribution deviated from a center of the filament. When the difference of the birefringence index is $30\times10^{-3}$ or more, a superior crimp can be generated. Further when a crystal growth rate obtained by the wide-angle X-ray diffractometry is 0.4 or more, the obtained crimp has a superior fastness to crimp.

The crystal growth rate of the polyester can be measured by latterly described method, the nearer to 1 the value of crystal growth rate comes, the bigger the crystal growth is. It is apparent that the crystal in the crimped multifilament in accordance with the present invention is extremely grown by the fact that a value of the crystal growth rate of a conventional filament manufactured by a lower speed spinning and drawing process is 0.3 or less. A preferable crystal growth rate is 0.5 or more.

As described herebefore, the crimped multifilament in accordance with the present invention can be obtained by simultaneously satisfying the three following factors.

(1) The distribution having eccentricity of birefringence index
(2) Random crimp
(3) Highly growth crystal structure The crimped multifilament in accordance with the present invention can show superior bulkiness and fastness to crimp or the basis of the above structure.

The fastness to crimp is expressed as a resistance against a stretching stress applied to the filament and a recovering force of the crimp under a load. When, for example, the crimped multifilament is used as a state of a bulked continuous filaments, i.e., B.C.F. to a carpet, even if excess stretching stress is applied to the filament during a twisting process and a tufting process, there is little lowering of the crimp and superior bulkiness is remained. The recovery force of the crimp is also superior.

In general, when B.C.F. is tufted to make the carpet, the crimped multifilament becomes to a mutually crowded state and then the crimped multifilament is applied with restriction caused by a load corresponding to 0.2 m/g. While, B.C.F. is supplied from a wound package and B.C.F. is rewound from the package and tufted. In this case, the crimp in B.C.F. decreases greatly due to creep generated in the package. Accordingly, when the recovery force of crimp is weak, the crimp do not sufficiently recover due to the restriction after the tufting process and thus properties of the carpet becomes remarkably inferior.

Even if the crimp is greatly decreased due to the creep, the crimped multifilament in accordance with the present invention can recover again the crimp thereof by a boiling water treatment and even if the multifilament is under the restriction, the crimped multifilament in accordance with the present invention has superior recovery force of the crimp over that of the conventional B.C.F.

When the crimped multifilament (in this case, mentioned as a tow) in accordance with the present invention is cut to make staple fibers and then the staple fiber is supplied to card, stretch of the crimp is very small and thus a good carding processability can be expected.

A cross section of the crimped multifilament in accordance with the present invention is not limited to a circle, a yarn having an odd cross section such as a trilobate, a square or the like, or a hollow yarn can be used. A denier of a filament is not particularly specified either, subject to around 50 d or less.

If necessary, an entanglement may be applied to the crimped filament.

A method for manufacturing the crimped multifilament in accordance with the present invention will be described hereafter.

Figure 6:
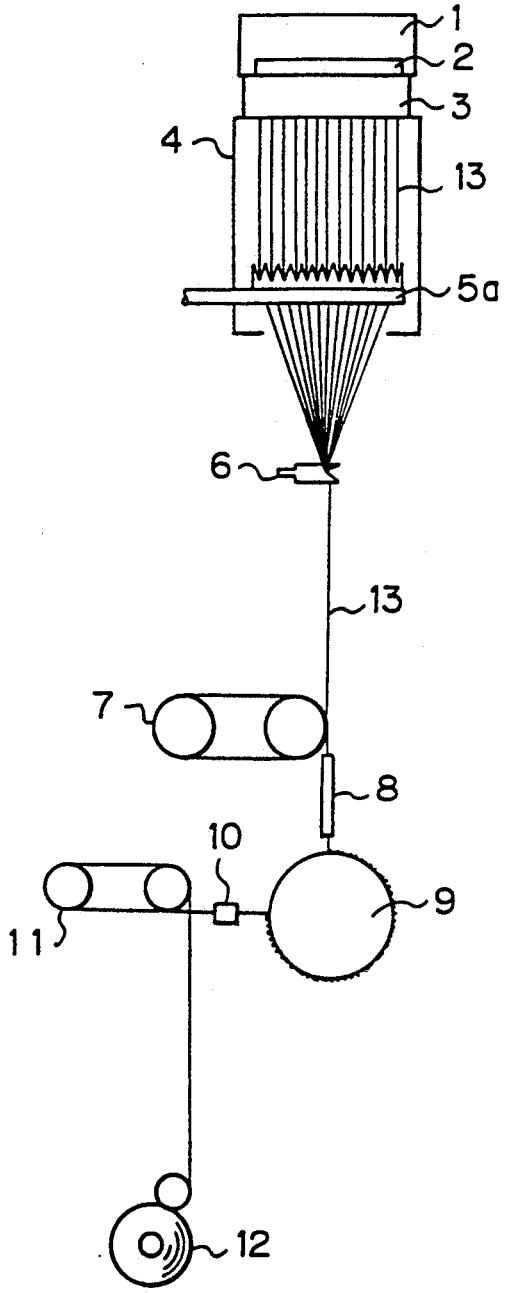
FIGS. 6 and 7 are schematic front views showing an example of a spinning machine and processing machine for carrying out the present invention, respectively.

FIG. 6 shows an example of a spinning and heat-treating apparatus of implementing a manufacturing method in accordance with the present invention.

Filaments 13 extruded from a spinneret 2 mounted on a spinhead 1 are cooled by a cooling air chamber 4. In a region where the filaments 13 maintain a high temperature, the filaments are asymmetrically cooled by applying an aqueous liquid from an aqueous liquid applicator Sa to one side of the filaments. In this case, the aqueous liquid is applied to the filaments which are separated each other.

The filaments 13 are converged and oiled by an oiling nozzle 6, and then taken up by a high-speed take-up roll 7. Subsequently, the filaments 13 are relaxation-heat treated by a heat-treating apparatus 8 to obtain a random crimp, imparted an entanglement by means of a cooling drum 9 and an entangling nozzle 10, and through a tension control roll 11 wound up to a package 12. In this case a liquid injecting nozzle is used as the heat-treating apparatus 8.

FIG. 6 schematically shows the apparatus in FIG. 5 further provided with a drawing means, in which the filaments 13 are drawn between a take-up roll 7 and a drawing roll 7'.

Figure 8:
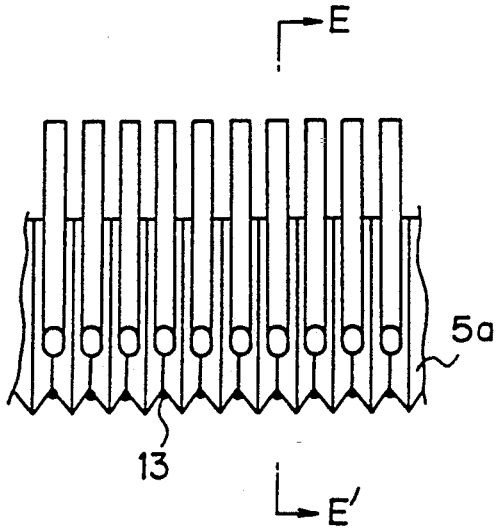
FIGS. 8(A), 8(B), 9(A) and 9(B) are schematic front views showing an example of a water applying device for use in an asymmetric cooling of the present invention, respectively.
Figure 8:
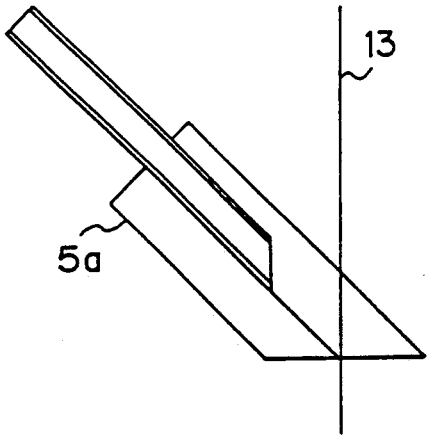
Figure 9:
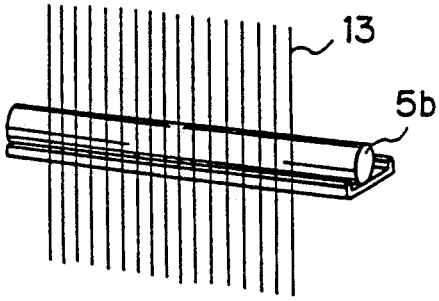
Figure 9:
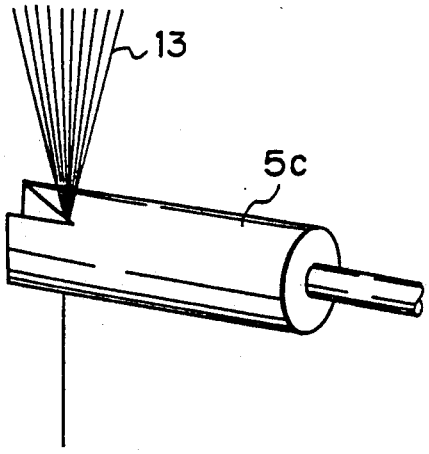

FIGS. 8 and 9 are schematic drawings of carrying out the water applying operation in accordance with the present invention. FIG. 8(A) is a schematic front view of a separating nozzle separating the filaments from each other, FIG. 8(B) is a sectional view taken at the line E—E' in FIG. 8(A), FIG. 9(A) shows an example of a roll method in which filaments are aligned in a plane and then the aqueous liquid is applied to one side of the plane of filaments, and FIG. 9(B) shows an example of a nozzle method applying the liquid water to converged filaments from one side thereof.

In the manufacturing method of the present invention, it is required that the filaments extruded from the spinneret should be air-cooled, should be supplied with aqueous liquid in the region where the filaments are cooled down to a temperature of 100° C., to thereby cool asymmetrically, and should be spun at a spinning rate of 4000 m/min or more.

When the spinning rate is less than 4000 m/min, the difference $\delta(\Delta_n)$ in the birefringence indexes between the outer layer and the inner layer of the filament section is not allowed to enlarge which is the object of the present invention, and the difference $\delta(\Delta_n)$ in the birefringence indexes which has once occurred may be caused to disappear by the subsequent drawing or the like. Further, in the filament after heat-treating, the crystal is prevented from fully growing, resulting in the shortage of fastness to crimp of the obtained crimped filaments.

The spinning speed at which the object of the present invention can be achieved is within the range of 5000 m/min to 8000 m/min. In case of the spinning speed of 8000 m/min or more, it is possible to obtain multifilaments of the invention by subjecting to an extremely great volume of aqueous liquid, whereas plenty of aqueous liquid must be required to adjust the crystal growth rate of the filament, bringing about a scattering of the aqueous or other trouble.

In view of mechanical characteristics and formation of structure required as the filaments, the most desirable spinning speed is 5500 to 7500 m/min.

With regard to polyester, the Journal of the Textile Society (T135–T142), No. 4 (1981), Vol. 37) reports that 8000 m/min or more is required to obtain a ununiform configuration of the sectional birefringent indexes, while regarding polyamide, Japanese Examined Patent Publication (Kokoku) No. 64-6283 shows that the difference in the birefringent indexes of the order of $6\times10^{-3}$ at most can be obtained at 10000 m/min. As compared with the above facts, the filaments of the present invention are much improved.

Within the range of spinning speed in accordance with the present invention, there is no fear of prominent increase in the spinning tension, or breakage of the filaments during spinning, thus enabling a stable and industrial execution.

The remarkable feature of the present invention lies in the fact that the filaments extruded from the spinneret are air-cooled, and supplied with aqueous liquid before the temperature of the filaments reaches 100° C. or below, thus conducting an asymmetrical cooling.

By subjecting the filaments under such high-temperature to the asymmetrical cooling through an aqueous liquid, there appear the crystal growth rate and the eccentric distribution of the birefringent indexes which both feature the filaments of the present invention. In the case where the temperature of the filament is less than 100° C. when applied with the aqueous liquid, the object of the present invention is not to be achieved regardless of the volume of water to be applied other conditons.

As the temperature of the filaments is higher than 100° C. at the time of applying the aqueous liquid, so the difference $\delta(\Delta_n)$ in the birefringent indexes enlarges. Nevertheless, the temperature above 250° C. of the filaments causes trouble such as a breakage of the filaments during the application of the aqueous liquid. Therefore, the preferred temperature of the filaments is within the range of 250° C. to 100° C.

In a melt spinning, a polymer is generally extruded from the spinneret at a temperature of 260° C. to 320° C.

In the method of the present invention, cooling of the filament previous to the application of an aqueous liquid is carried out through a cooling air, which is generally employed in the melt extrusion. The position of the filaments relative to the spinneret where the filaments have a temperature of 100° C. or more which is suitable for executing the present invention, differs depending on the spinning speed and fineness of the filament. Supposing the spinning speed is 4000 m/min or more, and the fineness is 1 to 5 denier which is normally used for clothing, it is within about 100 cm below the spinneret. The aqueous liquid of the present invention is therefore within the above range.

With respect to polyamide, it is required that a temperature of the filament applied with the aqueous liquid is 100° C. or more, preferably 130° C. or more.

Besides, for carpets, a filament having a fineness of about 10 to 30 denier is used. In this case, the application of the aqueous liquid is carried out at a position within about 300 cm below the spinneret. Further, different from polyester in the case of polyamide, there is not generally seen a rapid slenderizing of the yarn diameter during the spinning process at the high-speed spinning under the condition free from any application of aqueous liquid. However, in the spinning subjected to the aqueous liquid of the present invention, a distinctive slenderizing was observed at the applying point of the aqueous liquid. in other words, it has been definitely shown by the present invention for the first time that the application of the aqueous liquid to the filament under a high-temperature causes compulsive appearance of the slenderizing point.

Magnification of the difference $\delta(\Delta_n)$ in the birefringence indexes and the eccentric structure intended in the present invention can be attained by the application of the aqueous liquid.

With respect to polyester, it is required that a temperature of the filament applied with the aqueous liquid is 150° C. or more, when the spinning speed is above around 6000 m/min, it is known that there is observed a rapid slenderizing of the yarn diameter during the spinning process (Journal of Textile Society, pp. 499–507, No. 11 (1982), Vol. 38). The aqueous liquid of the present invention is applied at a position of about 5 cm or more above the slenderizing position as a reference point (neck point), preferably, at about 5 cm or more preferably 10 cm or more above it. For example, when multifilament constituted with filament having a fineness of 3 denier is spun at a spinning speed of 6000 m/min, and the slenderizing position is 70 cm (at this position, a temperature of filament is around 100° C.) below the surface of the spinneret, the aqueous liquid is applied at a position within 65 cm (at this position, a temperature of filament is around 150° C. or more) below the surface of the spinneret, preferably, within 60 cm (at this point, a temperature of filament is around 200° C. or more) below it.

An orientation and crystallization of the polyester are extremely easily generated in the high-speed spinning process, and then the microstructure in the filament is greatly influenced by a difference of only 1 cm to 2 cm in the position applying the aqueous liquid. Accordingly, determination of the aqueous liquid applying position must be done exactly. When the aqueous liquid is applied to the filament having a temperature of less than 150° C., the difference $\delta(\Delta_n)$ in the birefringence index become insufficient, the obtained multifilament is a crimped multifilament having weak crimps and after applying the heat treatment under relaxation to the obtained multifilament, increment of the crimp is not obtained.

As an aqueous liquid for cooling filaments in the present invention, water, a normal spinning lubricant emulsion, or the like is available. For convenience, water may be used. Moreover, the lower the temperature of the aqueous liquid, the better. Nevertheless, the present invention can be accomplished without cooling below the normal temperature in particular.

A method of applying the aqueous liquid in a state that the filaments are separated from each other, a method of applying the aqueous liquid in a state that the filaments are arranged in a plane, or a method of applying the aqueous liquid in a state that several or ten several filaments are converged can be used for the application of the aqueous liquid.

The method of applying the aqueous liquid in the state that the filaments are separated from each other can be preferably used for the polyamide multifilament constituted with filaments having a denier of around 10 denier or more. In the present invention, this method is referred to as the "separated nozzle method". FIG. 8(A) shows an example of the separated nozzle method. Each filament is independently applied with the aqueous liquid by a group of nozzles 5*a* arranged in a mutually separated state.

To more clarify a state that the filament is applied with the aqueous liquid, FIG. 8(B) which is a sectional view taken along the line E—E' of FIG. 8(A) is shown. A top end of the nozzle is formed to a sharp shape and this shape is a suitable shape to make a resistance caused by contact with the filaments to small and to cool asymmetrically the filaments.

The method of applying the aqueous liquid in the state that the filaments are arranged in the plane can be preferably used for the polyester multifilament constituted with a filament having a denier of around 10 denier or less. In the present invention, this method is referred to as the "Roll method".

FIG. 9(A) shows an example of the roll method. It is preferable that a resistance caused by contact with the filament is small. Accordingly a diameter of the roll may be determined in a range of 10 mm to 50 mm.

A method of applying the aqueous liquid in a state that several or ten several filaments are converged can be preferably used for the multifilament constituted with filaments having a denier of 1 d to 5 d. In the present invention, this method is referred to as the "Nozzle method".

However, other methods can be also employed except that the object of the present invention is impaired. The quantity of the aqueous liquid applied to the filament is represented by weight percentage relative to the filament.

In the present invention, the filaments are asymmetrically cooled and the crystal growth rate is suppressed by applying the aqueous liquid to the filaments having a higher temperature.

It is possible in the present invention that the higher the quantity of the aqueous liquid to be applied is, the lower the crystal growth rate is suppressed at the same filament temperature. An application of the aqueous liquid of about 10 wt% or more is required to achieve the object of the present invention. In case the application of the aqueous liquid reaches 500 wt% or more, it is necessary to prevent an excess aqueous liquid from scattering. The preferable quantity of the aqueous liquid is 20 to 300 wt%. And the quantity of the aqueous liquid of 20 to 50 wt% is used in the separated nozzle method and the roll method.

In the case that the aqueous liquid is applied in the state that the plurality of filaments are converged, such as the nozzle method, the filaments tend to cause troubles such as a breakage of the filaments arising from a mutual fusing and the like, due to its high-temperature of 100° C. or more. It is a marvelous discovery of the present invention that the above-mentioned fusing phenomenon completely ravels out to obtain an extremely stable spinning by applying an aqueous.

To be concrete, when the nozzle method as shown in FIG. 5(*b*) is used to apply the aqueous liquid, even if three to twenty filaments are converged, a stable spinning can be satisfactorily carried out without any adhesion of single yarn.

The asymmetrical cooling in accordance with the present invention can be attained by combination of the high-speed spinning process a sinning speed of which is 4000 m/min or more and the process of applying the aqueous liquid on one side of the filaments. Namely, the asymmetrical cooling is attained by that, when the filaments is in contact with the aqueous liquid applied to the one side of the filaments, a membrane of the aqueous liquid, i.e., a surface tension of liquid is broken by a high speed running of the filaments and results in application of the aqueous liquid on only one side of the filaments. This technical fact can be confirmed by observing a contacting portion between the filaments and the aqueous liquid.

When the spinning speed of less than 4000 m/min is used and the aqueous liquid is applied on one side of the filaments, the membrane of the aqueous liquid is not broken and thus the whole surface of the filaments are covered with the aqueous liquid. Accordingly, the asymmetrical cooling cannot be attained.

In the present invention, it is required that after the asymmetrical cooling, a drawing operation, a drawing ratio of which is between 1.0 and 1.5, is applied and then a heat treatment, a temperature of which is 150° C. or more is applied. In a case of a spinning speed of around 4000 to 5000 m/min, it is preferable to apply the drawing operation of a drawing ratio of 1.5 or less to improve the mechanical properties of the filaments. In a case of a spinning speed of around 5,000 m/min or more, a crimped multifilament having mechanical properties useful for practical use can be obtained with the application of the drawing operation.

It is most preferable that a multifilament is spun at the spinning speed of 5,000 m/min or more to make a crimped multifilament without the application of a drawing operation in view of obtaining high productivity with simple process.

In a case of a spinning speed between around 4,000 m/min to 5,000 m/min, when the drawing ratio exceeding from 1.5 is used, the distribution in the birefringence index disappears and thus the object of the present invention cannot be attained.

It is preferable that the drawing be carried out by heat-drawing at the glass transition temperature of the polymer or more.

The heat-treating needs to be conducted at a temperature of around 150° C. or more, preferably under a substantially relaxed condition.

The present invention is characterized in that the filaments previous to the heat-treatment have a lower crystal growth rate whereas the filaments subjected to the heat-treatment are permitted to grow larger. This is a remarkable change which has not been anticipated so far, of which reason is not yet cleared up. It is guessed however that a higher crystal growth rate peculiar to the high-speed spinning and potentialized into a freeze by an application of aqueous liquid, is actualized by a high-temperature heat-treatment.

Figure 11:
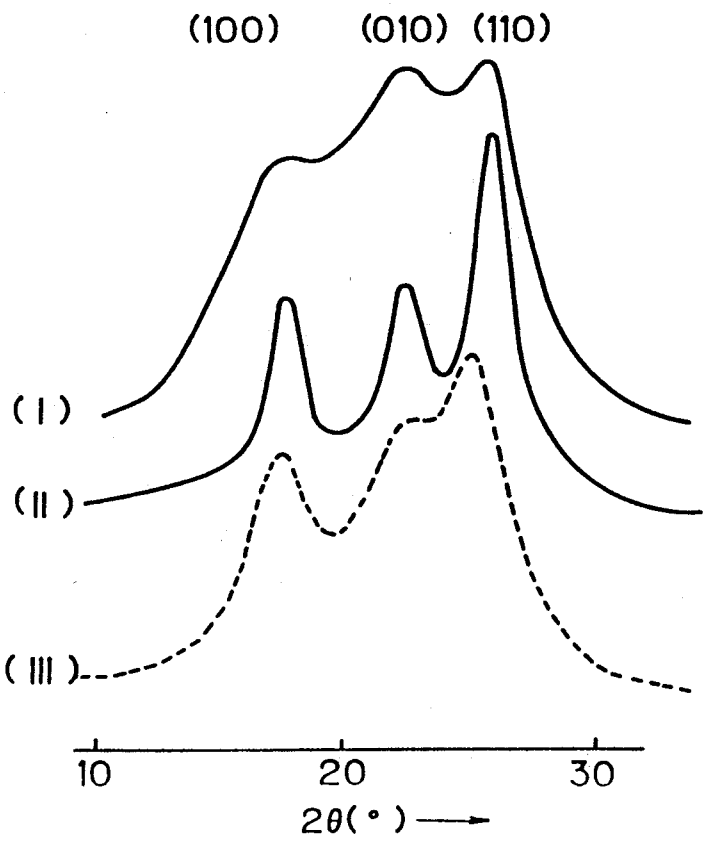
FIGS. 10 and 11 are graphs showing an example of an X-ray diffraction strength curve obtained in the measurement of crystal growth rate of the multifilament in accordance with the present invention; and, FIG. 12 is a view illustrating a crimp generation ratio of the crimped multifilament.
Figure 10:
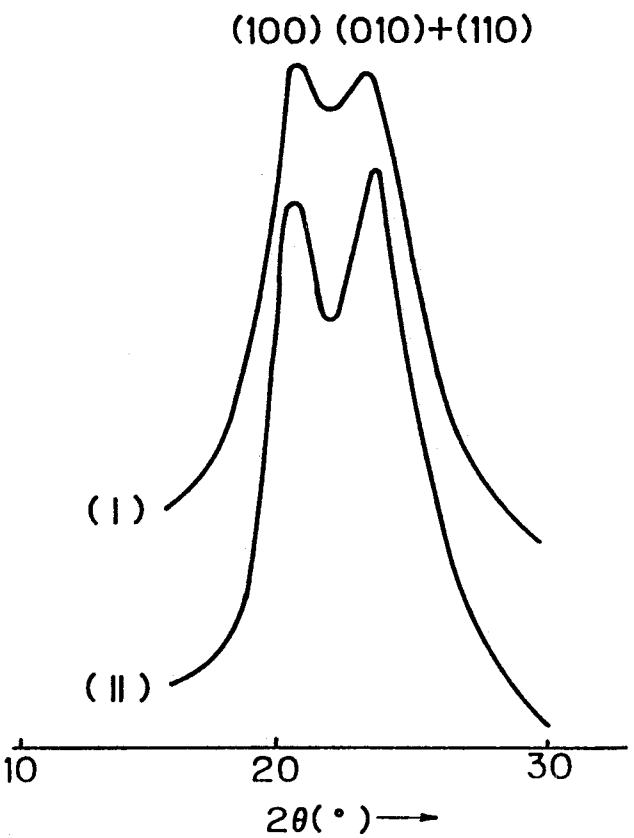

FIGS. 10 and 11 schematically show the growth of a crystal subjected to a heat-treatment. FIG. 10 shows an example using nylon 66 as a polymer, in which reference numeral (I) represents a wide-angle X-ray diffraction pattern of the filament previous to the heat treatment, and (2) represents a wide-angle X-ray diffraction pattern of the filament subjected to the heat-treatment. FIG. 11 shows an example using polyethylene terephthalate as a polymer, in which in the same manner as FIG. 11, reference numeral (I) stands for a wide-angle X-ray diffraction pattern of the crimped filament previous to the heat-treatment, (II) stands for that subjected to the heat treatment, and (III) stands for that of a conventional filament manufactured by a lower spinning speed and drawing method.

Such change in the crystal structure was found for the first time by the present invention. A multifilament having only a spiral crimp can be manufactured from a multifilament obtained by using the high-speed spinning herebefore, but the random crimped multifilament can be first obtained on the basis of discovery of the above technical concept.

In a case that a temperature of the heat-treating is less than around 150° C., the crystal is not allowed to fully grow and hence it is difficult to obtain crimped yarns having a superior fastness to crimp which the present invention aims to provide. The temperature of the heat-treatment is preferably around 180° C. or more.

In order to accomplish the objects of the present invention, it is desirable that the heat-treating be carried out substantially under a relaxation, preferably under the relaxation of the order of 5% or more. When it is conducted substantially under a stretching condition, there arises a reduction in the number of crimps and a deficiency of the distribution of the birefringent indexes.

As a relaxation heat-treating apparatus of this kind, for example, a fluid nozzle which is disclosed in Japanese Unexamined Patent Publication (Kokai) No. 59-71440, a jet processing apparatus disclosed in Japanese Examined Patent Publication (Kokoku) No. 58-30423, or other means may be appropriately selected. A high temperature air, a saturated vapor or a unsaturated vapor can be generally used as a heated fluid used in the jet processing method.

When B.C.F. of the polyamide is used to the manufacture of the crimped multifilament, the jet processing method using a fluid nozzle may be adapted. In this case, a random crimped multifilament having a superior fastness to crimp can be obtained by a combination of the fiber structure formed by the asymmetric cooling and an effect caused by the jet processing method.

In a case that the polyester crimped multifilament is used as a staple fiber, it is not always to use the jet processing method, and, for example, it is possible to accumulate the fibers on a running net and apply the heat treatment under the relaxation of the fibers.

In a case of using the polyester, the fibers before the application of the heat treatment are not crimped, but the crimped multifilament having a sufficient crimped shape can be obtained by the above heat treatment under the relaxation in place of the use of the jet processing method. This is a remarkable matter compared with a fact that a crimped multifilament having a spiral shape have been only obtained by a method disclosed in Japanese Unexamined Patent Publication (Kokai) No. 62-23816.

In a case that a crimped multifilament is used to make a carpet, it is possible to increase the quantity of the polymer extruded from a hole to 7 to 35 g/min.hole by using the method in accordance with the present invention. This value is larger i.e., around 2 or 3 times, compared to the value of 3 to 6 g/min.hole in a conventional polyester spinning and thus high productivity can be attained.

To carry out effectively the method in accordance with the present invention, it is preferable to sequentially conduct the high-speed spinning and the heat treatment, or the high-speed spinning, the heat treatment and the drawing. The most effective one is that the high-speed spinning and crimping treatment in which the high-speed spinning is first conducted and the heat treatment is applied to the filament without drawing.

The process in which the crimped multifilament is manufactured by using sequentially the spinning process, the drawing process and the crimping process has been disclosed in, for example, U.S. Pat. No. 3,854,177. But the maximum spinning speed of the known continuous process is 4000 m/min at most. The continuous process having the speed of 4,000 m/min or more can be attained by the present invention for the first time.

Various embodiments in accordance with the present invention and comparative examples will be described hereafter. Measuring methods of characteristics of a crimped filament in accordance with the present invention are described hereafter.

(A) TEMPERATURE OF A FILAMENT

A temperature of a filament is measured in a non-contact state by a scanning type infrared pyrometer arranged along a spinning line.

(B) STRENGTH AND ELONGATION

A strength and elongation of the multifilament is measured by TENSILON UTM-II-20 tensiometer supplied from Toyo Boldwin Co., Ltd. under conditions of an initial length of 20 cm, and a tensile speed of 20 cm/min.

(C) DISTRIBUTION OF BIREFRINGENCE INDEX AND ECCENTRICITY

When a cross-sectional shape of a filament is a circle, a distribution of a birefringence index and its eccentricity can be measured by a transmission quantitative interference microscope. When the cross-sectional shape of the filament is an odd shape, the distribution of the birefringence index and its eccentricity can be found by dyeing a filament and observing the dyed filament by an optical microscope.

In a case that the filament has a circular cross-sectional shape

These are measured by an interference fringes method using a transmission quantitative interference microscope (INTERFACO supplied by Carl Zeiss Yener Co., Ltd.). A green light having a wavelength of 549 mμ is used, filaments are immersed in the encapsulant which is inert to filaments and having the refractive index (N) so as to impart a deviation within the range of 0.2 to 2 wavelength of the green light to the interference fringes, the interference fringe pattern is photographed which is formed when the filament axis is so arranged as to be perpendicular to the optical axis of the interference microscope and the interference fringes, and the obtained photograph is enlarged by about 1500 magnifications to analyze it.

The analysis is made in the same way as embodiments described in Japanese Examined Patent Publication (Kokoku) No. 64-8086 in detail.

In the case of the filament having a circular section, there are observed V-shaped or U-shaped interference fringes as shown in FIG. 11. FIG. 3(C) is a schematic view showing an eccentric distribution of the birefringence index of the crimped filament in accordance with the present invention. The difference of the birefringent indexes between the external layer and the internal layer of the filament is calculated from the photograph of FIG. 3(A) which is obtained by rotating the filament in FIG. 3(C) about an axis X—X of the filament by 90°.

Now, let the radius of the filament be R, the outer layer is situated at a distance of 0.8 R from the center of the filament in FIG. 3(A) which is denoted by $\Delta n_{0.8}$. The inner layer means the center of the filament which is denoted by $\Delta n_0$.

The difference $\delta(\Delta_n)$ in birefringent indexes can be expressed as $$\delta(\Delta_n)=\Delta n_{0.8}-\Delta n_0.$$

In a case that the filament has an odd cross-sectional shape

Filaments are dyed in a state that filaments are not overlapped each other under the following conditions.

Dyeing of a polyamide filament

A weight of sample: 0.5 g
Dyestuff: Kayarus Supra Grey VGN 300% owf
Bath ratio: 1 : 500
Dyeing temperature: 98° C.
Dyeing time: 30 min Dyeing or a polyamide filament A weight of sample: 0.5 g
Dyestuff Resalin Blue FBL 300% owf
Bath ratio: 1 : 500
Dyeing temperature: 85° C.
Dyeing time: 90 min.

A cross-section of the dyed filament is photographed by an optical microscope. When there is a distribution of the birefringence index and its eccentricity in the filament, a distance which the dyestuff can enter from a surface of the filament to an inside thereof becomes irregular about a center of the filament.

(D) CRYSTAL GROWTH RATE (IWR)

IWR is measured by a wide-angle X-ray diffractometry.

The measurement is performed by a X-ray generator (RU-200pL) supplied from Rigaku Denki Co., Ltd., a fiber sample measuring apparatus (FS-3), a goniometer (8G-9), a scintillation counter as a counter, a pulse height analyzer as a counting unit and a CuXα ray (λ=1.5418Å) monochromatized by a nickel filter. The X-ray generator is operated on 30 kV and 80 mA.

In this case, there are employed a scanning rate of 4°/min, a chart speed of 10 mm/min, a time constant of 1 sec, a collimator of 2 mmϕ, and a receiving slit 1.9 mm high and 3.5 mm wide.

In a case of polyamide

When a polyhexamethylene adipamide is used as the polyamide, two main reflections appear on the equator as shown in FIG. 10.

From the lower angle side, there are seen reflections at plane (100) and plane {(010)+(110)}, respectively. A base line is defined as a straight line which links two points on a diffraction strength curve corresponding to $2\theta=7°$ and $2\theta=35°$. A diffraction strength is defined as a length of a perpendicular line drawn from each peak to the base line.

A crystal growth rate (IWR) of polyamide is expressed by the following formula.

$$IWR = 1 - \frac{2H_1}{H_2 - H_3}$$

where $H_1$ is the minimum diffraction strength between plane (100) and plane {(010) + (110)}, $H_2$ is the maximum diffraction strength of plane (100), and $H_3$ is the maximum diffraction strength of plane {(010)+(110)}. The nearer to 1 the value of IWR comes, the higher the crystal growth rate is.

When a polycaproamide is used as the polyamide, a crystal growth rate is defined as growth of $\gamma$ type crystalline.

In general, the polycaproamide has two crystalline forms, i.e., $\alpha$ type and $\gamma$ type, and there are three main reflections on the equator. Namely from the lower angle side, there are seen reflections at plane (200) of $\alpha$ type crystalline, at plane (020) of $\gamma$ type crystalline and at plane {(202)+(002)} of $\alpha$ type crystalline.

In this case, IWR is defined as a fraction of $\gamma$type crystalline obtained by a method of R. F. Stepaniak described in "Journal of Applied polymer Science" Vol. 23 1747–1757, 1979. A separation of a X-ray diffraction peak is performed by RAD-C system multiple peak separation program supplied from Rigaku Denki Co., Ltd. and a computer.

In a case of polyester

In general, polyester presents three main reflections on the equator as shown in FIG. 11.

From the lower angle side, there are depicted three main reflections at plane (100), (010), and (110), respectively within the range of $2\theta=17°$ to 26°. A base line is defined as a straight line which links two points on a diffraction strength curve corresponding to $2\theta=7°$ and $2\theta=35°$. A diffraction strength is defined as a length of a perpendicular line drawn from each peak to the base line. Let the diffraction strength at the valley between the plane (010) and the plane (110) to $H_1$, and the diffraction strength at the peak of (110) to be $H_2$, the crystal growth rate (IWR) is expressed by the following formula.

$$IWR = 1 - \frac{H_1}{H_2}$$

The nearer to 1 the value of IWR comes, the higher the crystal growth rate is. $H_3$ is the maximum diffraction strength of plane {(010)+(110)}

(E) CRYSTAL PERFECTION INDEX

In a case of polyamide

A X-ray diffraction strength curve obtained by a measuring method according to ACS is used as a measurement of a crystal perfection index.

A method used to obtain ACS is, for example, a method using an equation of Scherrer described in the champt 7 of "X-ray diffraction of high polymer". L. E. Alexander, published from Kagaku Dojin Shuppan.

A base line is defined as a straight line which links two points on a diffraction strength curve corresponding to $2\theta=7°$and $2\theta=35°$. A vertical line is arranged between a peak point on the diffraction strength curve and the base line, and a middle point is marked at a half position of the vertical line. A horizontal line passing through the middle is described against the diffraction strength curve. When the two main reflections are clearly separated, the horizontal line can crosses two shoulders corresponding to the peak of the diffraction strength curve, but when the separation is inferior, the horizontal line can only cross one shoulder. A width of the horizontal line between two cross points is measured. When the horizontal line crosses only one shoulder, a distance between one cross point and the middle point is measured and the obtained value is multiplied by two. A line width is defined as a value obtained by changing the above value to a radian expression, respectively. The line width is further corrected by the following method.

$$\beta = \sqrt{B^2 - b^2}$$

Wherein:

B stands for the line width measured by the above described method b stands for Broadening constant and is a line width of a peak of reflection at plane (111) of Si single crystal and changed as a radian expression, i.e., a half band width, An apparent size of a micro crystal is obtained by the following equation $$ACS(Å) = k\lambda/B\cdot\cos\theta$$

A method of Dismore and Statton is used to obtain the crystal perfection index (CPI).

$$CPI\ (\%) = \left[\frac{\text{Spacing of refraction at plane (100)}}{\text{Spacing of refractions at plane \{(010) + (110)\}}} - 1\right] \times \left(\frac{100}{A}\right)$$

wherein: A is 0.189.

The nears to 100 the value of CPI, the higher the perfection of the crystal is.

(F) NUMBER OF CRIMPS

A measurement of a number of crimps is performed according to JIS L 1015 by using a photograph as shown in FIG. 1(A).

When the crimped filaments wound on a package or the like is left to stand for extended periods of time as it is under high tension, there is a fear that the number of crimps and the crimp extensibility are apparently lessened, thus failing to show a true value. Accordingly in the crimp measurements of the present invention, the crimped filaments are heat-treated by boiling water under a condition of 98° C.×5 min, and then are left to stand in a room at a constant temperature and humidity (temperature of 20° C.+2°, relative humidity of 65%+2%) for twenty-four hours.

The moisture-conditioned filaments are loaded with 2 mg/d to measure the number of crimps per 1 inch.

In view of unevenness of samples, ten points are measured for each sample to obtain a mean value.

(G) CRIMP EXTENSIBILITY

Filaments are formed into a small hank of 20 turns using a counter wheel with a circumference of 1.125 m. The obtained hank is heat-treated by boiling water under no load at 98° C. for 5 minutes, and then are left to stand in a room at a constant temperature and humidity (temperature of 20±2° C., relative humidity of 65±2%) for twenty-four hours.

The moisture-conditioned filaments are loaded 2 mg/d, and one minute later the length $l_1$ of hank is measured. Next, the small hank is loaded with 0.1 g/d, and one minute later the length $l_2$ of hank is measured. The crimp extensibility is expressed as follows.

$$\text{Crimp extensibility} = \frac{l_2 - l_1}{l_2} \times 100\ (\%)$$

In view of unevenness of samples, ten points are measured for each sample to obtain a mean value.

(H) FASTNESS TO CRIMP

The sample whose crimp extensibility has been measured is loaded with 250 mg/d, and one minute later the load is removed. Subsequently the crimp extensibility is again measured. Let the former and the latter value of the crimp extensibility to be $CE_1$ and $CE_2$ respectively, a fastness to crimp can be represented by the following expression.

$$\text{Fastness to crimp} = \frac{CE_2}{CE_1} \times 100\ (\%)$$

Providing the fastness to crimp is not less than about 60%, there is free from any inconveniences in practice.

(I) CRIMP GENERATION RATIO UNDER LOAD

This is a method of measuring a force generating crimp under a load. Filaments are formed into a hank of 8 turns using a lap reel with a circumference of 1.0 m and folded to have a hank having a length of 50 cm. The hank is first loaded with 0.1 mg/d by using a load weight and then the weight is successively increased from 0.2 mg/d to 1.6 mg/d at an interval of 0.2 mg/d. In this test, the hank is immersed into hot water controlled at 60° C.±1° C. A length l (cm) of the hank after 1 minute from the time that the hank is immersed into the hot water is measured, and the crimp generation ratio is obtained by the following equation.

$$\text{Crimp generation ratio} = \frac{50 - l}{50} \times 100\ (\%)$$

(J) UNEVENNESS OF FIBER SURFACE

Using a scanning electron microscope, the surface of the fiber is photographed by a known method at a magnification of 2000 diameters.

(K) DEGREE OF ODD SHAPE

A degree of odd shape of a filament having a trilobate cross section is obtained by the following equation $$\text{Degree of odd shape} = \frac{b}{a}$$

wherein a stands for a diameter of a circle inscribed concave portions in a cross section of a filament b stands for a diameter of a circle, circumscribed convex portions in a cross section of a filament.

(L) EVALUATION OF CARPET PROPERTY

An evaluation of the property of a carpet is an evaluation performed by a visual inspection and a handling inspection of an expert and an evaluation performed in Japanese Carpet Inspection Associates (Foundation) according to JIS L 1021.

EMBODIMENT 1

A nylon 66 composed substantially of a polyhexamethylene anipamide having a relative viscosity $\eta$rel of 2.9 is spun by using a spinning and crimping apparatus shown in FIG. 6. The relative viscosity is measured by using 1% solution of 95% $H_2SO_4$. A rectangle spinneret having 68 holes a shape of which is a trilobate equally spaced with three slits having a length of 0.70 mm and a width of 0.15 mm is used as the spinneret.

Nylon 66 is extruded by an extrusion rate of 9.8 g/min.hole at a spinning temperature of 300° C., and taken out a. a speed of 600 m/min as a multifilament of 1000 d.

A non-heated type heat insulating tube having a length 20 cm is arranged in a state sealed with a spinning face of the spinneret on a lower portion of the spinneret. The multifilament is cooled by a cool air blown from an air chamber and having a temperature of 20° C. at a speed of 0.3 m/sec.

Water is applied to one side of the filaments from a direction opposite the blowing direction of the cool air by a separating nozzle shown in FIG. 6 to perform asymmetrical cooling. A quantity of the water applied to the filament is around 30 wt%. Next, an oil is applied to the filament by an oil feeding nozzle and then the multifilament are continuously fed through a taking roll having a circumferential speed of 6,000 m/min and a temperature of 200° C. to a jet stuffer nozzle, to apply a crimping treatment to the filaments. In the taking operation, the multifilament is not applied with a drawing operation. A heated and compressed has having a temperature of 250° C. and a pressure of 5 kg/cm$^2$ is used in the crimping treatment.

The crimped multifilament is cooled and then wound to a cheese-like package at a winding speed of 5,100 m/min and a relaxation ratio of the multifilament of around 15% is used.

Properties of the various crimped multifilaments having a random crimp obtained by changing a position of a water applying roll from the spinning face of the spinneret are shown in Table 1. In Table 1, properties of multifilament before applying the crimping treatment can be obtained by measuring a multifilament wound directly from the taking roll on a cheese-like package.

Next, he properties of the crimped multifilament in a case that a carpet is manufactured from the crimped multifilament are compared. The multifilaments of 1150 d/68 f in Examples 1 to 6 are applied with a S-twist of 40 T/meter, respectively, three twisted multifilaments are plied and the plied multifilaments are applied with a twist of 40 T/meter to have a tuft yarn, respectively. Loop carpets having a weight per unit area of 750 g/m$^2$ are manufactured by piercing the tuft yarn under conditions of a pile length of 6 mm and 7.4 stitch inch. The obtained carpets are dyed with a ready-made three primary color dyestuff, i.e., a dyestuff blended with Tectilon Yellow 4R, Tectilon Red 2B and Tect Blue 4G supplied from Ciba Geigy.

A carpet manufactured from the crimped multifilament filament No. 6 has a disorder of pile raws, inferior bulkiness and lack of useability of a commercial product.

Carpets manufactured from the crimped multifilaments filaments No. 1 to 5 have a good alignment of the piles and a superior bulkiness.

The carpets of the crimped multifilaments No. 1 to No. 5, have a compression ratio of 41 to 42%, a compressive modulus of 90 to 91% and a thickness reduction ratio under a dynamic loading operations of 10000 times of 14 to 15%, respectively, and result in a sufficient performance as a carpet.

A nylon 66 crimped multifilament obtained by treating a nylon 66 crimped multifilament by an injecting treatment apparatus disclosed in Japanese Examined Patent No. 58-30423 under a condition by which the same value of crimp extensibility as that of the crimped multifilament of Example 2 can be obtained, is prepared as a comparative example, and a crimp generating-ratio of the crimped multifilaments of Example No. 2 and the comparative example are measured.

Figure 12:
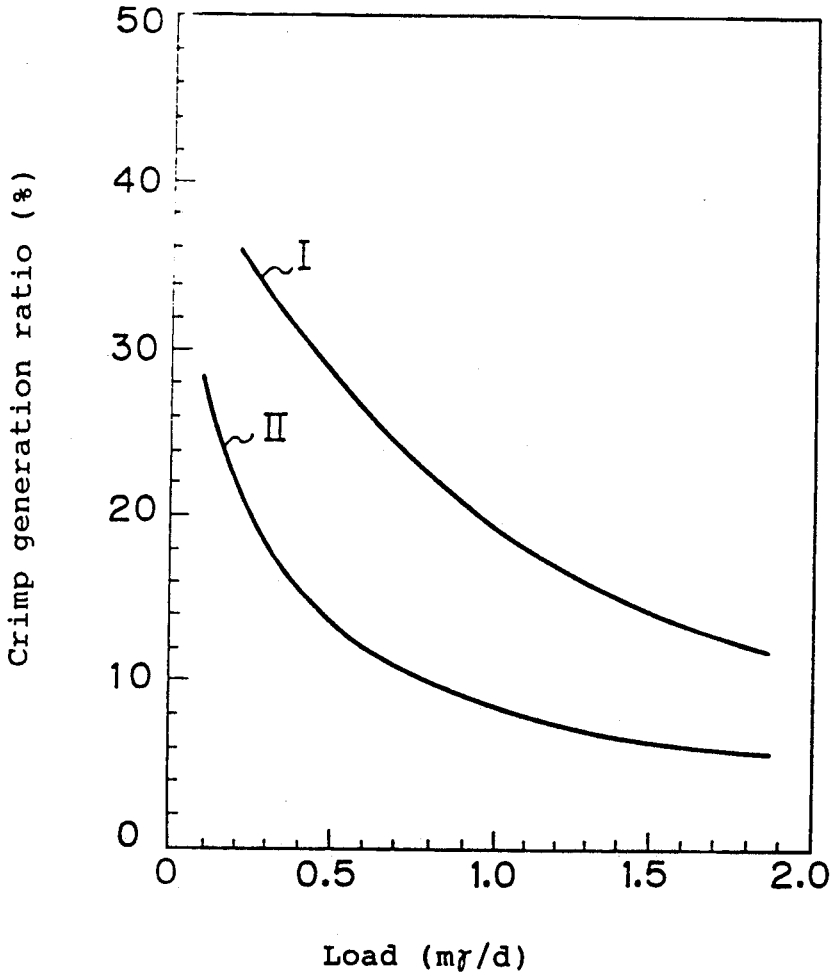

FIG. 12 shows a relationship between the crimp generating ratio and a load applied to the multifilament for the both multifilaments.

As shown in FIG. 12, the crimped multifilament in accordance with the present invention has an extremely higher crimp generation ration compared with that of the conventional crimp multifilament.

A relationship between the spinning speed and an extrusion per a hole are as follows.

| | |
|---|---|
| Spinning speed: 3,000 m/min; | Extrusion rate per a hole: 12.0 g/min · hole |
| Spinning speed: 4,000 m/min; | Extrusion rate per a hole: 12.4 g/min · hole |
| Spinning speed: 5,000 m/min; | Extrusion rate per a hole: 11.1 g/min · hole |
| Spinning speed: 6,000 m/min; | Extrusion rate per a hole: 13.3 g/min · hole |
| Spinning speed: 7,000 m/min; | Extrusion rate per a hole 15.6 g/min · hole |

A water is applied to the multifilament on a position below 200 cm from a spinneret by the separate nozzle system. Namely, a water applying roll is arranged on a position blow from a surface of the spinneret. A spinning speed is changed from 3,000 m/min to 7,000 m/in.

TABLE 1

| No. | Position of water supply (cm) | Temperature of filament (°C.) | IWR before crimp-processing | Strength (g/d) | Elongation (%) | Degree of odd shape | Presence of eccentricity | IWR | CPI (%) | Number of crimps (pcs/in) | Crimp extensibility (%) | Fastness to crimp (%) | Presence of unevenness on filament surface |
|---|---|---|---|---|---|---|---|---|---|---|---|---|---|
| 1 | 115 | 205 | 0.118 | 1.4 | 26 | 1.88 | yes | 0.340 | 74 | 27 | 48 | 80 | no |
| 2 | 155 | 188 | 0.151 | 1.9 | 31 | 1.85 | yes | 0.344 | 75 | 23 | 37 | 82 | no |
| 3 | 195 | 170 | 0.166 | 2.7 | 37 | 1.85 | yes | 0.330 | 75 | 20 | 28 | 81 | no |
| 4 | 235 | 153 | 0.182 | 3.2 | 40 | 1.83 | yes | 0.288 | 75 | 15 | 24 | 79 | no |
| 5 | 275 | 120 | 0.195 | 3.4 | 51 | 1.82 | yes | 0.239 | 76 | 11 | 17 | 71 | no |
| 6 | no water supply | — | 0.193 | 2.9 | 56 | 1.81 | no | 0.199 | 72 | 7 | 13 | 54 | yes |

No. 6 is a comparative example.

EMBODIMENT 2

This Embodiment 2 aims to measure a distribution of a birefringence index of a crimped multifilament obtained in the Embodiment 1.

Various crimped multifilaments are manufactured by the same method as that of Embodiment 1, except that a nylon 66 having a relative viscosity reel of 2.6 is spun at a temperature of 295° C. by using a spinneret including spinning holes having a diameter of 0.35 mmϕ.

Properties of the obtained crimped multifilaments are shown in Table 2.

A temperature of the filament applied with water during the above range of the spinning speed may be around 170° C. to 180° C. Next an oil is applied to the filament by an oil feeding nozzle, and the multifilament is not applied with drawing operation, but directly fed into a jet stuffer apparatus shown in FIG. 6, and the multifilament is applied with the same crimping treatment as that of Embodiment 1 but this relaxation ratio of the multifilament is around 15.

In cases that the spinning speeds of 3,000 m/min and 4,000 m/min are used in the present embodiment, a roll 7 in FIG. 6 is heated at 150° C., and the multifilament

TABLE 2

| No. | Position of water supply (cm) | Temperature of filament (°C.) | IWR before crimp-processing | Strength (g/d) | Elongation (%) | Difference in birefringent indexes $\delta(\Delta n) \times 10^{-3}$ | Presence of eccentricity | IWR | CPI (%) | Number of crimps (pcs/in) | Crimp extensibility (%) | Fastness to crimp (%) | Presence of unevenness on filament surface |
|---|---|---|---|---|---|---|---|---|---|---|---|---|---|
| 1 | 120 | 205 | 0.115 | 1.3 | 23 | 32 | yes | 0.339 | 75 | 24 | 42 | 82 | no |
| 2 | 160 | 188 | 0.140 | 1.8 | 29 | 26 | yes | 0.340 | 75 | 22 | 34 | 83 | no |
| 3 | 200 | 170 | 0.163 | 2.7 | 34 | 20 | yes | 0.335 | 75 | 18 | 25 | 80 | no |
| 4 | 240 | 153 | 0.176 | 3.1 | 40 | 16 | yes | 0.292 | 74 | 15 | 19 | 78 | no |
| 5 | 280 | 120 | 0.182 | 3.2 | 48 | 8 | yes | 0.245 | 76 | 12 | 14 | 71 | no |
| 6 | no water supply | — | 0.191 | 2.5 | 52 | 0 | no | 0.200 | 73 | 6 | 12 | 51 | yes |

No. 6 is a comparative example.

EMBODIMENT 3

A multifilament of a nylon 66 and constituted with filaments of 20 d is manufactured by a high speed spinning method which is the same as that of the Embodiment 1.

are drawn at a drawing ratio of 1.8 and 1.4, respectively. The drawing operation is not applied to cases using the spinning speeds of 5,000 m/min, 6,000 m/min and 7,000 m/min.

Properties of the obtained crimped multifilaments are shown in Table 3.

Examples No. 6 to 8 in Table 3 are comparative examples obtained without an asymmetrically cooling operation applying an aqueous liquid, and the filament of the examples No. 2 to No. 5 have a distribution in which a bifringence index is deviated.

A degree of odd shapes of a cross section of each filament in this embodiment is between 1.7 and 1.8, and thus a cross sectional shape of each filament is a trilobate.

As shown in Table 3, the crimped multifilament obtained by applying an aqueous liquid at a spinning speed of 4,000 m/min or more in accordance with the present invention has superior generation and fastness of the crimp, and the filament has no irregular surface thereon and has superior transparency.

TABLE 3

| No. | Spinning rate (m/min) | Execution of water supply | Drawing ratio times | IWR before crimp-processing | Strength (g/d) | Elongation (%) | Presence of eccentricity | IWR | CPI (%) | Number of crimps (pcs/in) | Crimp extensibility (%) | Fastness to crimp (%) | Presence of unevenness on filament surface |
|---|---|---|---|---|---|---|---|---|---|---|---|---|---|
| 1 | 3,000 | yes | 1.8 | 0.061 | 2.6 | 62 | no | 0.185 | 68 | 7 | 9 | 68 | no |
| 2 | 4,000 | yes | 1.4 | 0.063 | 2.2 | 34 | yes | 0.250 | 74 | 13 | 15 | 72 | no |
| 3 | 5,000 | yes | 1.0 | 0.086 | 2.2 | 53 | yes | 0.325 | 71 | 16 | 29 | 82 | no |
| 4 | 6,000 | yes | 1.0 | 0.133 | 2.2 | 33 | yes | 0.332 | 75 | 20 | 40 | 84 | no |
| 5 | 7,000 | yes | 1.0 | 0.172 | 2.4 | 23 | yes | 0.356 | 78 | 23 | 38 | 84 | no |
| 6 | 4,000 | no | 1.4 | 0.131 | 2.3 | 28 | no | 0.130 | 58 | 5 | 6 | 57 | yes |
| 7 | 5,000 | no | 1.0 | 0.190 | 2.3 | 54 | no | 0.199 | 66 | 5 | 5 | 55 | yes |
| 8 | 6,000 | no | 1.0 | 0.196 | 2.5 | 47 | no | 0.200 | 71 | 7 | 7 | 52 | yes |

Nos. 1, 6, 7 and 8 are comparative examples.

EMBODIMENT 4

This Embodiment 4 aims to measure a distribution of a birefringence index of a crimped multifilament obtained in the Embodiment 3.

Various crimped multifilaments are manufactured by the same method as that of Embodiment 3, except that a nylon 66 having a relative viscosity $\eta$rel of 2.6 is spun at a temperature of 295° C. by using a spinneret including spinning holes having a diameter of 0.35 mm$\phi$.

Properties of the obtained crimped multifilaments are shown in Table 4.

As shown in Table 4, the crimped multifilament obtained by applying an aqueous liquid at a spinning speed of 4,000 m/min or more in accordance with the present invention has superior crimp and fastness thereof, and the filament has completely no irregular surface thereon.

TABLE 4

| No. | Spinning rate (m/min) | Execution of water supply | Drawing ratio times | IWR before crimp-processing | Strength (g/d) | Elongation (%) | Difference in birefringent indexes $\delta$ ($\Delta$n) × $10^3$ | Presence of eccentricity | IWR | CPI (%) | Number of crimps (pcs/in) | Crimp extensibility (%) | Fastness to crimp (%) | Presence of unevenness on filament surface |
|---|---|---|---|---|---|---|---|---|---|---|---|---|---|---|
| 1 | 3,000 | yes | 1.8 | 0.059 | 2.5 | 58 | 4 | no | 0.184 | 68 | 7 | 8 | 70 | no |
| 2 | 4,000 | yes | 1.4 | 0.064 | 2.1 | 32 | 12 | yes | 0.246 | 74 | 12 | 14 | 70 | no |
| 3 | 5,000 | yes | 1.0 | 0.085 | 2.1 | 51 | 27 | yes | 0.320 | 71 | 17 | 26 | 81 | no |
| 4 | 6,000 | yes | 1.0 | 0.130 | 2.3 | 34 | 29 | yes | 0.325 | 75 | 24 | 38 | 82 | no |
| 5 | 7,000 | yes | 1.0 | 0.177 | 2.6 | 25 | 33 | yes | 0.354 | 78 | 22 | 36 | 83 | no |
| 6 | 4,000 | no | 1.4 | 0.120 | 2.4 | 30 | 0 | no | 0.125 | 58 | 5 | 7 | 59 | yes |
| 7 | 5,000 | no | 1.0 | 0.187 | 2.4 | 58 | 0 | no | 0.194 | 66 | 4 | 4 | 58 | yes |
| 8 | 6,000 | no | 1.0 | 0.196 | 2.8 | 53 | 0 | no | 0.201 | 71 | 6 | 6 | 52 | yes |

Nos. 1, 6, 7 and 8 are comparative examples.

EMBODIMENT 5

In this embodiment, several treatment temperatures in a jet stiffer are used for multifilaments of Example No. 3 and Comparative Example No. 6 in Embodiment 1 to apply a crimping treatment as shown in Table 5. A constant pressure of 5 kg/cm$^2$ is used as the pressure of a heated and compressed gas.

Properties of the obtained crimped multifilaments are shown in Table 5.

As shown in Table 5, when a treatment temperature of 150° C. or more is used, a superior crimped multifilament can be obtained.

TABLE 5

| No. | Example No. used in Embodiment 1 | Processing temperature (°C.) | IWR | Number of crimps (pcs/in) | Crimp extensibility (%) | Fastness to crimp (%) | Presence of unevenness on filament surface |
|---|---|---|---|---|---|---|---|
| 1 | No. 3 | 140 | 0.182 | 5 | 7 | 53 | no |
| 2 | | 150 | 0.210 | 12 | 13 | 63 | no |
| 3 | | 180 | 0.261 | 14 | 19 | 75 | no |
| 4 | | 220 | 0.266 | 16 | 24 | 80 | no |
| 5 | | 260 | 0.354 | 22 | 37 | 81 | no |
| 6 | No. 6 | 220 | 0.196 | 7 | 13 | 58 | yes |
| 7 | | 260 | 0.198 | 8 | 19 | 55 | yes |

Nos. 1, 6 and 7 are comparative examples.

EMBODIMENT 6

A nylon 6 composed substantially of a polycaproamide having a relative viscosity ηrel of 3.2 is spun by using a spinning and crimping apparatus shown in FIG. 6. The relative viscosity is measured by using 1% solution of 95% $H_2SO_4$. The nylon 6 is extruded from a spinneret having 68 holes a diameter of which is 0.35 mmϕ, at a temperature of 290° C., and a multifilament of 1000 d is spun and taken out at a speed of 6,000 m/min Another example of multifilaments are spun and taken out by using, a spinneret having 68 holes of trilobate shape constituted with three slits having a same length of 0.70 mm and a same width of 0.15 mm. An extrusion rate of the nylon 6 is 9.8 g/min.hole.

A heat tube having a length of 20 cm and an inner temperature of which is 200° C. are arranged on a lower portion of the spinneret, and the multifilament is cooled by a cool air having a temperature of 20° C. and a speed of 0.3 m/sec and blown from a cool air chamber.

Water is applied to one side of the filaments having a temperature of 155° C. at a position below 250 cm from the spinneret by a separating nozzle shown in FIG. 6 to perform asymmetrical cooling. A quantity of the water applied to the filament is around 20 wt%. Next, an oil is applied to the filament by an oil feeding nozzle and then the multifilament are continuously fed through a taking roll having a circumferential speed of 6,000 m/min and a temperature of 180° C. to a jet sutffer nozzle, to apply a crimping treatment to the filaments. In the taking operation, the multifilament is not applied with a drawing operation. The treatment conditions in this case are a temperature of 230° C., a pressure of 5 kg/cm$^2$ and a relaxation ratio of 9%. The obtained crimped multifilament has a random crimp.

Properties of the various crimped multifilaments are shown in Table 6.

TABLE 6

| | 1000d/68f round section | 1000d/68f trilobate section |
|---|---|---|
| Degree of odd shape | | 1.81 |
| Strength (g/d) | 3.3 | 3.1 |
| Elongation (%) | 54 | 55 |
| Difference in birefringent indexes δ (Δn) × $10^{-3}$ | 12 | unmeasurable |
| Presence of eccentricity | yes | yes |
| IWR | 0.288 | 0.287 |
| Number of crimps (pcs/in) | 13 | 18 |
| Crimp extensibility (%) | 18 | 27 |
| Fastness to crimp (%) | 80 | 80 |
| Presence of unevenness on surface | no | no |

EMBODIMENT 7

A polyethyleneterephthalate having an intrinsic viscosity η of 0.62 is spun by a spinning machine as shown in FIG. 6 using a spinneret having 24 holes a diameter of which is 0.35 mmϕ at a temperature of 300° C. A heating tube of an aluminum body in which a heater is embedded and having an inner diameter of 12 cm and a length of 25 cm is in a state such that a gap between a spinning face of the spinneret and the heating tube is not made on a lower portion of the spinneret, and a temperature of the heater is determined at 250° C.

The multifilament coming out from the heating tube is cooled by cool air having a temperature of 20° C. and a speed of 0.30 m/sec blown from a laterally blown cool applied to the multifilament by 40 wt% for a weight of the multifilament to perform asymmetrical cooling. A position of the asymmetrical cooling caused by the application of the water is 50 cm below the spinning face of the spinneret. A temperature of the multifilament in this position is around 180° C. to 190° C. in a range of the spinning speed as shown in Table 7.

The multifilament applied with the asymmetrical cooling is further applied with an oil, to make the multifilament of 50 d/24 f without drawing, and is wound different spinning speeds are used in this embodiment as shown in Table 7.

A position of a neck point appearing in a spinning operation and measured from the spinneret is a value measured when the water is not applied. The measurements are performed by a diameter instrument type 460 Ω/2 supplied from ZIMMER GmbH and observation with the naked eye, and values obtained by the both methods are identical.

When the water is applied, it is confirmed that the neck is generated at a position of 50 cm below the spinning face of the spinneret in the all cases. Further it is confirmed that all multifilaments obtained by applying the water have a distribution in which the birefringence index is eccentric, but those multifilaments before applying a heat treatment are multifilaments having no crimp.

Figure 7:
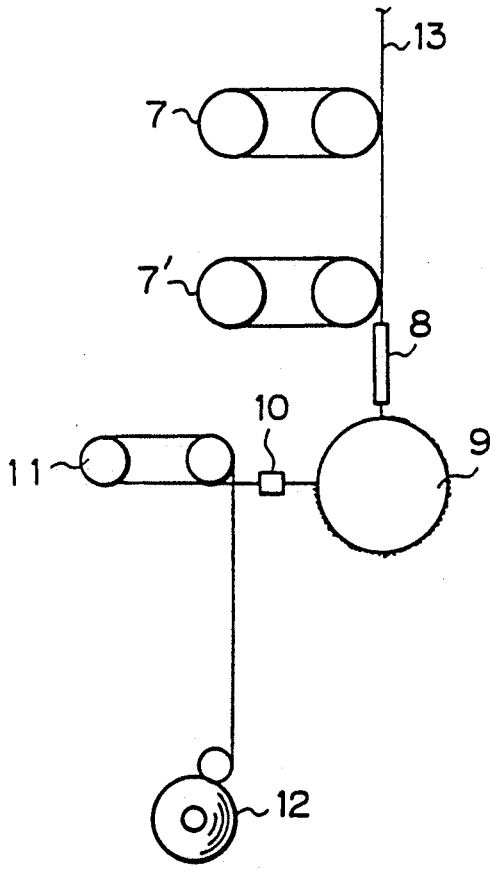

Next, those multifilaments are applied with a crimping treatment without drawing by an apparatus shown in FIG. 7. Rolls 7 and 7' are not heated and has a constant circumferential speed of 3,000 m/min in this case. A heated and compressed air having a temperature of 240° C. and a pressure of 2 kg/cm$^2$ is supplied from a jet stuffer nozzle. A relationship between the roll 7, and a roll 11 is determined in such a manner that a boiling shrinkage ratio of the obtained crimped multifilament becomes to around 1% or less.

IWR of the multifilament before applying the crimping treatment and properties of the crimped multifilament are shown in Table 7.

Unevenness of a surface of the crimped multifilament is not appeared and the surface is smooth in the crimped multifilament in this embodiment.

As shown in Table 7, the polyester crimped multifilament in accordance with the present invention with a presence of the eccentricity.

TABLE 7

| | Spinning rate (m/min) | Neck point (cm) | IWR before crimp-processing | Strength (g/d) | Elongation (%) | Difference in birefringent indexes δ (Δn) × $10^{-3}$ | Presence of eccentricity | IWR | Number of crimps (psc/in) | Crimp extensibility (%) | Fastness to crimp (%) |
|---|---|---|---|---|---|---|---|---|---|---|---|
| 1 | 5,000 | 50 | unmeasurable due to amorphous substance | 3.7 | 69 | 57 | yes | 0.491 | 28 | 35 | 91 |
| 2 | 6,000 | 50 | 0.130 | 4.1 | 58 | 59 | yes | 0.561 | 23 | 24 | 88 |
| 3 | 7,000 | 50 | 0.324 | 4.3 | 46 | 63 | yes | 0.655 | 16 | 17 | 82 |

TABLE 7-continued

| | Spinning rate (m/min) | Neck point (cm) | IWR before crimp-processing | Strength (g/d) | Elongation (%) | Difference in birefringent indexes $\delta(\Delta n) \times 10^{-3}$ | Presence of eccentricity | IWR | Number of crimps (psc/in) | Crimp extensibility (%) | Fastness to crimp (%) |
|---|---|---|---|---|---|---|---|---|---|---|---|
| 4 | 8,000 | 50 | 0.502 | 3.9 | 37 | 70 | yes | 0.718 | 13 | 12 | 78 |
| 5 | 5,000 | 68 | 0.511 | 3.9 | 59 | 2 | no | 0.570 | 7 | 6 | 54 |
| 6 | 6,000 | 63 | 0.642 | 4.2 | 48 | 4 | no | 0.651 | 5 | 7 | |
| 7 | 7,000 | 60 | 0.673 | 4.4 | 42 | 7 | no | 0.685 | 6 | 6 | 56 |
| 8 | 8,000 | 57 | 0.717 | 4.1 | 33 | 7 | no | 0.722 | 4 | 3 | 51 |

Nos. 5-8 are comparative examples without water supply.

EMBODIMENT 8

This embodiment is a case that a polyester crimped multifilament is cut to have a staple fiber and a spun yarn is manufactured of the staple fiber.

In the embodiment 7, a rectangle spinneret having 250 holes constituted by aligning 50 holes spaced with a pitch of 6 mm to a hole line and arranging 5 hole lines with a distance of 6 mm between them is used. A heating tube having a lengthwise length of 35 cm and a lateral is arranged on a position below the spinning face of the spinneret.

Non-crimped multifilament of 500 d/250 f is spun under the same condition as those appeared in No. 2 using a spinning speed of 6,000 m/min and No. 6 in Table 7 corresponding the embodiment 7.

Application of the water is performed by a roll system shown in FIG. 9(A) and using a roll having a diameter of 3 cm and a length of 35 cm. Next obtained non-crimped multifilament is applied with the same heat treatment as that used in the embodiment 7 to have a crimped multifilament.

The obtained two crimped multifilaments are cut to staple fibers having a biased cut staple diagram of fiber lengths between 80 m and 110 mm. Those staple fibers are supplied to a roller card having a diameter of 60 inch to perform a carding test of the obtained staple fibers.

A carding operation is performed without trouble for the staple fiber corresponding No. 2 of the embodiment 7 and a sliver in which neps are not generated can be obtained. A spun yarn of 1/40 Nm is spun from this sliver.

The staple fiber corresponding to No. 6 of the embodiment 7 cannot be processed in a card due to a greatly generation of an opener waste at an exit of a press cylinder of the card.

EMBODIMENT 9

This embodiment corresponds to the embodiment 7 except that a fiber having an odd shaped cross section is used.

In this case, a spinneret having 24 holes a shape of which is a trilobate constituted with three same slots having a length of 0.28 mm and a width of 0.06 mm.

The same spinning conditions as those in the embodiment 7 are used, and a measurement of a neck point generated in a spinning process are by a naked eye observation.

Properties of the polyester crimped multifilament are shown in Table 8. A degree of odd shape is between 1.8 and 1.9.

TABLE 8

| | Spinning rate (m/min) | Neck point (cm) | IWR before crimp-processing | Strength (g/d) | Elongation (%) | Presence of eccentricity | IWR | Number of crimps (psc/in) | Crimp extensibility (%) | Fastness to crimp (%) |
|---|---|---|---|---|---|---|---|---|---|---|
| 1 | 5,000 | 50 | unmeasurable due to amorphous substance | 3.6 | 67 | yes | 0.510 | 30 | 38 | 89 |
| 2 | 6,000 | 50 | 0.141 | 4.2 | 56 | yes | 0.584 | 24 | 27 | 89 |
| 3 | 7,000 | 50 | 0.330 | 4.2 | 43 | yes | 0.654 | 19 | 19 | 85 |
| 4 | 8,000 | 50 | 0.513 | 3.8 | 35 | yes | 0.720 | 15 | 14 | 81 |
| 5 | 5,000 | 67 | 0.530 | 4.0 | 56 | no | 0.584 | 8 | 9 | 58 |
| 6 | 6,000 | 60 | 0.650 | 4.3 | 47 | no | 0.660 | 8 | 10 | 58 |
| 7 | 7,000 | 58 | 0.675 | 4.2 | 39 | no | 0.684 | 7 | 9 | 55 |
| 8 | 8,000 | 55 | 0.719 | 4.0 | 28 | no | 0.721 | 5 | 5 | 54 |

Nos. 5-8 are comparative examples without water supply.

EMBODIMENT 10

The polyethylene terephthalate is spun under the same conditions as those in the embodiment 7, an asymmetrical cooling and an oil applying is applied, and then a multifilament is taken at a spinning speed of 6,500 m/min without drawing. A water application is applied by a nozzle system shown in FIG. 9(B) and the water of a room temperature is applied to the fiber by 100 wt% thereof. A position where the asymmetrical cooling is applied is determined to different positions for examples.

Diameter of a filament is changed at a position applied with a water in the all examples and thus generation of the neck is confirmed.

The multifilament applied with the water has an eccentric distribution of the birefringence index and has no the crimp.

After the application of the water, the multifilament is continuously applied with a crimping treatment by using a treating apparatus shown in FIG. 6 without a taking operation to have a crimped multifilament of 50 d/24 f. In this treatment using a jet stuffer nozzle, a temperature of 250° C. and a constant pressure of 4 kg/cm$^2$ are used, and a relaxation ratio is determined in such a manner that a boiling shrinkage ratio of the crimped multifilament becomes to around 1% or less.

IWR of the multifilament before applying the crimping treatment and properties of the crimped multifilament are shown in FIG. 9.

Unevenness of a surface of the crimped multifilament is not appeared and the surface is smooth in the crimped multifilament in this embodiment.

As shown in Table 9, the polyester crimped multifilament in accordance with the present invention has a superior crimp and fastness thereto. Further this polyester crimped multifilament has a feature that an initial modulus thereof is small. Soft and bulky handling can be obtained in a knitted fabric of this polyester crimped multifilament due to the above feature.

TABLE 9

| No. | Position of water supply (cm) | Temperature of filament (°C.) | Relaxation rate (%) | IWR before crimp-processing | Strength (g/d) | Elongation (%) | Initial modulus (g/d) | Difference in birefringent indexes $\delta(\Delta n) \times 10^{-3}$ | Presence of eccentricity | IWR | Number of crimps (psc/in) | Crimp extensibility (%) | Fastness to crimp (%) |
|---|---|---|---|---|---|---|---|---|---|---|---|---|---|
| 1 | 40 | 215 | 25 | unmeasurable due to amorphous substance | 3.6 | 30 | 14 | 70 | yes | 0.502 | 27 | 35 | 92 |
| 2 | 45 | 200 | 15 | 0.234 | 3.8 | 35 | 26 | 53 | yes | 0.554 | 21 | 27 | 86 |
| 3 | 50 | 164 | 10 | 0.410 | 4.2 | 42 | 45 | 29 | yes | 0.580 | 16 | 21 | 87 |
| 4 | 55 | 155 | 7 | 0.436 | 4.2 | 45 | 59 | 22 | yes | 0.589 | 12 | 13 | 79 |
| 5 | no water supply | — | 3 | 0.596 | 4.3 | 48 | 82 | 2 | no | 0.611 | 5 | 9 | 58 |

No. 5 is a comparative example.

EMBODIMENT 11

A crimped multifilament is manufactured by the same conditions as those of No. 2 in Table 9 corresponding the example 10, except that a quantity of the water applying to the filament is changed as shown in Table 10. In the example in the above No. 2, the water is applied to the filament a temperature of which is 200° C.

Properties of the obtained crimped multifilament are shown in Table 10.

TABLE 10

| No. | Amount of water supply (wt %) | IWR before crimp-processing | Relaxation rate (%) | Strength (g/d) | Elongation (%) | Difference in birefringent indexes $\delta(\Delta n) \times 10^{-3}$ | IWR | Number of crimps (pcs/in) | Crimp extensibility (%) | Fastness to crimp (%) |
|---|---|---|---|---|---|---|---|---|---|---|
| 1 | 50 | 0.331 | 15 | 3.9 | 37 | 77 | 0.572 | 18 | 18 | 86 |
| 2 | 80 | 0.250 | 20 | 3.7 | 37 | 75 | 0.568 | 20 | 21 | 80 |
| 3 | 120 | 0.196 | 33 | 3.1 | 39 | 80 | 0.552 | 26 | 30 | 90 |
| 4 | 300 | 0.127 | 41 | 2.8 | 34 | 81 | 0.530 | 34 | 40 | 88 |

CAPABILITY OF EXPLOITATION IN INDUSTRY

A crimped multifilament in accordance with the present invention has superior transparency and bulkiness as a continuous filament and when the crimped multifilament are used to a carpet or a raised fabric, a product having a fastness and high-class feeling can be obtained. When the crimped multifilament is used as a staple fiber, there is no trouble in a card processability and a spinningability and thus it is possible to blend this staple fiber with another material, such as a wool, a cotton or the like.

A manufacturing method in accordance with the present invention has no trouble in a spinning process and crimping process of the crimped multifilament and thus the crimped multifilament can be easily manufactured at a high speed, accordingly the manufacturing method in accordance with the present invention has a high productivity and an extremely high industrial value.

Thus, the invention comprises a crimped multifilament composed of a thermoplastic polymer, wherein a birefringence index measured at an outer layer of a filament constituting the multifilament is larger than that of a birefringence index measured at a central portion of the filament, and the filament has a distribution in which a position having a smallest value of the birefringence index deviates from the center axis of the filament and has random crimps of 10 per inch or more.

The invention also comprises a polyamide crimped multifilament composed of a polyamide polymer, wherein a birefringence index measured at an outer layer of a filament constituting the multifilament is larger than that of a birefringence index measured at a central portion of the silament, and the filament has a distribution in which a position having a smallest value of the birefringence index deviates from a central axis of the filament, a crystal growth rate of 0.2 or more which is measured by a wide-angle X-ray diffractometry, and random crimps of 10 per inch or more.

A section of the filament constituting the polyamide multifilament is circular and the difference of the birefringence index between an outer layer and an inner layer of the filament is between $5\times10^{-3}$ and $45\times10^{-3}$ whereas the crystal growth rate measured by the wide-angle X-ray diffractometry m ay be 0.25 or more. The filament may also have crimps of 12 per inch or more and a surface of the filament may be smooth.

A polyhexamethylene adipamide may be used as the polyamide and has a crystal perfection index measured by a wide-angle X-ray diffractometry which is 70% or more.

The invention also comprises a polyester crimped multifilament composed of a polyester polymer, wherein a birefringence index measured at an outer layer of a filament constituting said multifilament is larger than that of a birefringence index measured at a central portion of the filament, and the filament has a distribution in which a position having a smallest value of the birefringence index deviates from a central axis of the filament, a crystal growth rate of 0.4 or more which is measured by a wideangle X-ray diffractometry, and random crimps of 10 per inch or more.

A section of the polyester filament constituting said multifilament is circular and the difference of the birefringence index between an outer layer and an inner layer of the filament is between $20\times10^{-1}$ and $100\times10^{-3}$ whereas the crystal growth rate measured by the wide-angle X-ray diffractometry may be 0.5 or more.

The invention also comprises a polyester staple fiber, composed of a polyester polymer, wherein a birefringence index measured at an outer layer of a filament constituting said multifilament is larger than that of a birefringence index measured at a central portion of the filament, and the filament has a distribution in which a position having a smallest value of the birefringence index deviates from a central axis of the filament, a crystal growth rate of 0.4 or more which is measured by a wide-angle X-ray diffractometry, and random crimps of 10 per inch or more.

In another embodiment, the invention also relates to a method for manufacturing a polyamide crimped multifilament by melt spinning a polyamide, characterized in that a multifilament extruded from a spinneret is asymmetrically cooled by applying an aqueous liquid to one side of the multifilament up to a state that a temperature of a filament constituting said multifilament becomes 100° C., and then is taken out at the spinning rate of 4,000 m/min or more. The aqueous liquid may be applied to the one side of the multifilament having a state in which filaments constituting the multifilament are substantially arranged in a plane. A taken multifilament is drawn at the drawing ratio between 1.0 and 1.5 and then is applied with a fluid injecting treatment at a temperature of 150° C. or more. The aqueous liquid may be applied to the note side of the multifilament up to a state that the filament is cooled to 130° C. The aqueous liquid may also be applied to the one side of the multifilament having a state in which filaments constituting the multifilament are mutually separated. In another embodiment, a multifilament is taken out at the spinning rate of 5,000 m/min or more and the fluid injecting treatment is applied to the undrawn multifilament. The fluid injecting treatment may also be applied at the temperature of 180° C. or more and the taking out operation and the fluid injecting treatment may be continuously applied.

The invention further comprises a method for manufacturing a polyester crimped multifilament by melt spinning a polyester, characterized in that a multifilament extruded from a spinneret is asymmetrically cooled by applying an aqueous liquid to one side of the multifilament up to a state that a temperature of a filament constituting said multifilament becomes to 150° C., and then is taken out at the spinning rate of 5000 m/min or more, and a taken multifilament is drawn at the drawing ratio between 1.0 and 1.5 and then is applied with a heat treatment under relaxation at a temperature of 150° C. or more. The aqueous liquid may be applied to the one side of the multifilament up to a state that the filament is cooled to 200° C. A multifilament may also be taken out at the spinning rate of 5,000 m/min or more and heat treatment under relaxation is applied to the undrawn multifilament. The heat treatment under relaxation may be a liquid injecting treatment and the taking gout operation and the heat treatment under relaxation may be continuously applied.

We claim:

1. A crimped multifilament composed of a thermoplastic polymer, wherein a birefringence index measured at an outer layer of a filament constituting said multifilament is larger than that of a birefringence index measured at a central portion of the filament, and said filament has a distribution of the birefringence in which a portion having a smallest value of the birefringence index deviates from the center axis of the filament and random crimps of 10 per inch or more.

* * * * *

UNITED STATES PATENT AND TRADEMARK OFFICE

CERTIFICATE OF CORRECTION

PATENT NO. : 5,281,476

DATED : January 25, 1994

INVENTOR(S) : Tadashi Koyanagi et al.

It is certified that error appears in the above-indentified patent and that said Letters Patent is hereby corrected as shown below:

On the title page, under item [19] and item [75], change "Koyonagi" to --Koyanagi--.

On the title page, item [57], Abstract, line 15, "from.a" should read --from a--.

Column 32, line 42, claim 1, "portion" should read --position--.

Signed and Sealed this

Twelfth Day of July, 1994

*Attest:*

*Attesting Officer*

BRUCE LEHMAN

*Commissioner of Patents and Trademarks*